US010813386B1

(12) United States Patent
Bajpai et al.

(10) Patent No.: US 10,813,386 B1
(45) Date of Patent: Oct. 27, 2020

(54) TRANSPORTABLE MOUTHPIECE

(71) Applicant: Puff Corporation, Los Angeles, CA (US)

(72) Inventors: Avinash Bajpai, Los Angeles, CA (US); Charlton Huang, Irvine, CA (US); Ryan Fitt, Santa Rosa, CA (US)

(73) Assignee: Puff Corporation, Los Angeles, CA (US)

( * ) Notice: Subject to any disclaimer, the term of this patent is extended or adjusted under 35 U.S.C. 154(b) by 0 days.

(21) Appl. No.: 16/659,188

(22) Filed: Oct. 21, 2019

Related U.S. Application Data

(60) Provisional application No. 62/893,707, filed on Aug. 29, 2019.

(51) Int. Cl.
*A24F 47/00* (2020.01)
*A24F 7/04* (2006.01)
*A24F 1/30* (2006.01)

(52) U.S. Cl.
CPC ..... *A24F 47/008* (2013.01); *A24F 1/30* (2013.01); *A24F 7/04* (2013.01)

(58) Field of Classification Search
None
See application file for complete search history.

(56) References Cited

U.S. PATENT DOCUMENTS 10,517,334 B1 * 12/2019 Volodarsky ..... A24D 3/17

FOREIGN PATENT DOCUMENTS

DE 102016012830 8/2017

OTHER PUBLICATIONS

Polar Bottle, Sport Cap, retrieved from polarbottle.com/product/bottles/free-replacement-cap/sport/ on Nov. 1, 2019 2019.
Lock & Lock, Lock & Lock, No BPA, Water Tight, Food Container, 2.5-cup, 20-oz, HPL933, retrieved from www.amazon.com/Water-Tight-Container-2-5-cup-HPL933/dp/B005BRGWZE on Nov. 1, 2019 Oct. 2014.
Smokea, Piecemaker Kahuna 2 in. Silicone Bong, retrieved from https://smokea.com/products/piecemaker-kahuna-2-silicone-bong?variant=37965420929 on Nov. 1, 2019 Jun. 2018.
Osprey, Hydraulics Bite Valve, retrieved from https://www.osprey.com/us/en/product/hydraulics-bite-valve-NONMAGVALV.html on Nov. 1, 2019 Apr. 2013.
Bray, Flowtek Triad Series, retrieved from www.bray.com/ball-valves/3-piece-valves/triad-series on Nov. 1, 2019 Mar. 2017.

* cited by examiner

*Primary Examiner* — Phu H Nguyen
(74) *Attorney, Agent, or Firm* — Bryan Cave Leighton Paisner LLP

(57) ABSTRACT

Aspects of the present invention relate to a transportable mouthpiece for use in inhalation of products in gas form, and including a sealable attachment piece.

28 Claims, 21 Drawing Sheets

TRANSPORTABLE MOUTHPIECE

CROSS REFERENCE TO RELATED APPLICATIONS

This application claims the benefit of priority from U.S. Provisional Patent Application 62/893,707 filed on Aug. 29, 2019, which is hereby incorporated by reference herein in its entirety.

FIELD OF THE INVENTION

Aspects of the present invention relate to a transportable mouthpiece for use in inhalation of a product in gas form, as well as devices and methods for using the mouthpiece. Aspects of the present invention further relate to a transportable mouthpiece that is sealable to inhibit and even prevent leakage of water from the mouthpiece during transport and/or storage thereof, as well as devices and methods for using the mouthpiece.

BACKGROUND

Devices for the inhalation of vaporizable and/or combustible products are becoming increasing popular, such as used for the purpose of aroma and/or inhalation therapy. Examples of such devices include vaporizers, which heat a substance such as tobacco, cannabis, lavender, chamomile, and many other types of plant material, to produce a vapor therefrom. Typical vaporizers may work by heating the substance through the use of direct heat or the use of hot air, such as with a heating plate or by using hot air, and to produce a vapor containing the substance that can be inhaled. Yet another example of such a device is a pipe or other smoking device, which typically generates a gas via combustion of the product (i.e., burning of the product), and thereby forming a gaseous combustion product for inhalation thereof.

However, the gas containing the vaporized substance and/or gaseous combustion products can in some instances be harsh on the throat and bronchial tubes. Accordingly, some devices use a cooling down process that allows water moisture to be included in the gas that is to be inhaled. These devices enable the user to inhale a cool gas and/or vapor that is relatively less harsh and irritating. The addition of water to the device may also allow for filtering of the gas prior to inhalation, such that irritating or unpleasant substances that may be entrained in the gas can be removed. An example of a portable vaporizing device that provides for inhalation of a vaporizable substance with overall excellent experience is the Puffco PEAK® device, which device is also described by U.S. patent application Ser. No. 16/373,170, filed on Apr. 2, 2019, the entirety of which application is hereby incorporated by reference herein.

An issue that can arise with devices using water or other sources of moisture to cool and/or filter a gas prior to inhalation is that the water provided in the device can be subject to leakage when the device or parts thereof are transported or disassembled for storage. Such unwanted leakage can make transport and/or storage of the devices unpleasant, due to the possibility of leakage of the device onto any bags, purses, or surfaces used to carry or store the device. While it may be possible to clean and completely dry the device to remove any residual water therefrom, in certain cases it may be inconvenient to completely dry the device, and/or a person using the device may not have the time necessary to allow for complete drying of the device.

Furthermore, the drying process may be inconvenient in those cases where the device is only being transported and/or stored for a short time and is intended to be subject to almost immediate refill and re-use.

Accordingly, there is a need for improved devices that allow for easy and convenient transport and/or storage, while reducing the likelihood of water and moisture leakage therefrom, to improve the experience and convenience of using such devices.

SUMMARY

Aspects of the disclosure are directed to a mouthpiece for the inhalation of a product in the form of a gas, the mouthpiece comprising: an inhalation outlet; a mouthpiece housing comprising one or more mouthpiece walls at least partly defining a mouthpiece internal flow path through the mouthpiece housing; a first opening at a first end of the mouthpiece housing; and at least one mouthpiece inlet configured to receive a flow of the gas at a second end of the mouthpiece housing. Embodiments of the mouthpiece can further comprise an internal gas flow structure extending into an interior region of the mouthpiece housing and having: a first chamber at least partly defined by at least one first housing that is configured to receive the flow of gas from the at least one mouthpiece inlet, the first chamber having an open end at a portion of the gas flow structure that is distal to the at least one mouthpiece inlet, and the at least one first housing comprising at least one first aperture therein that allows the flow of gas therethrough; a second chamber at least partly defined by at least one second housing that is configured to receive the flow of gas via the at least one first aperture from the first chamber and direct the flow of gas towards at least one second aperture formed in the at least one second housing; and a main chamber at least partly defined by the mouthpiece housing that is configured to receive the flow of gas from the at least one second aperture from the second chamber and direct the gas towards the first opening at the first end of the mouthpiece housing. According to certain embodiments, the second chamber and main chamber are adapted to be at least partly filled with water for cooling and/or filtering of the gas as it passes through the second and main chambers, and wherein the at least one second aperture is configured to allow a flow of water between the second chamber and the main chamber. Embodiments of the mouthpiece further comprise a sealable attachment piece configured to at least partly seal a portion of the internal flow path within the mouthpiece housing, the sealable attachment piece comprising: an upper sealing portion configured to be inserted into the first opening of the mouthpiece housing, the upper sealing portion configured to be transitioned between an open state in which gas is allowed to flow through the inhalation outlet, and a closed state in which gas is blocked from flowing through the inhalation outlet; and a lower sealing portion configured to be inserted into the open end of the internal gas flow structure, the lower sealing portion configured to be transitioned between an open state in which gas is allowed to flow through the at least one first aperture connecting the first and second chambers, and a closed state in which gas is blocked from flowing through the at least one first aperture between the first and second chambers, and an activating member configured to simultaneously transition the upper and lower sealing portions between the open and closed states upon activation thereof. According to certain embodiments, in a case where the upper sealing portion and lower sealing portion are in their respective closed states, the portion of the mouthpiece internal flow path between the at least one first aperture and the inhalation outlet is sealed to trap any gas and/or water therebetween, and in a case where the upper sealing portion and lower sealing portion are in their respective open states, the portion of the mouthpiece internal flow path is open to allow a flow of gas and/or water therethrough.

Aspects of the disclosure are further directed to a method of using the mouthpiece according to any embodiment herein, the method comprising:

(a) providing a volume of water to at least partially fill the main chamber and flow into the second chamber;

(b) adjusting the activating member to set the upper and lower sealing portions, respectively, in their open states;

(c) introducing a gas formed from a product intended for inhalation into the mouthpiece inlet;

(d) inhaling a flow of the gas entrained with vapor exiting the inhalation outlet;

(e) optionally, repeating (c)-(d); and (f) following (d)-(e), adjusting the activating member to set the upper and lower sealing portions, respectively, in their closed states.

Aspects of the disclosure further relate to a method of fabricating the mouthpiece claim according to any embodiment herein, the method comprising: providing the mouthpiece housing having the internal gas flow structure with the first chamber having the open first end, and at least one first aperture, and having the first opening at the first end thereof; providing the sealable attachment piece having the upper and lower sealing portions; inserting the sealable attachment piece into the first opening of the mouthpiece housing such that the lower sealing portion at least partly seals the open first end of the first chamber of the internal gas flow structure, to form at least a part of the internal gas flow path that directs gas through the at least one first aperture, and such that the upper sealing portion is sealed to a region of the mouthpiece housing about the first opening.

Aspects of the disclosure further relate to a portable electronic vaporizing device comprising: a base having comprising a gas flow path conduit therein, the gas flow path conduit comprising a conduit inlet and a conduit outlet; the mouthpiece according to any embodiment herein, wherein the mouthpiece is removably attachable to the base; and an atomizer that is removably attachable to the base, the atomizer comprising: an atomizer inlet configured to receive a flow of gas into the atomizer; a container within the atomizer housing that is capable of holding a vaporizable product, a heating element capable of heating the vaporizable product held in the container; and one or more atomizer outlets capable of receiving the flows of gas from the atomizer internal flow path, and providing the flow of gas to the conduit inlet of the base, wherein the flow of gas having the vaporizable product entrained therein flows from the atomizer through the gas flow path conduit of the base and to the mouthpiece inlet, and along the mouthpiece internal flow path to the inhalation outlet.

BRIEF DESCRIPTION OF THE DRAWINGS

The following drawings form part of the present specification and are included to further demonstrate certain aspects of the present invention. The invention may be better understood by reference to one or more of these drawings in combination with the detailed description of specific embodiments presented herein.

DETAILED DESCRIPTION OF THE INVENTION

Figure 18:
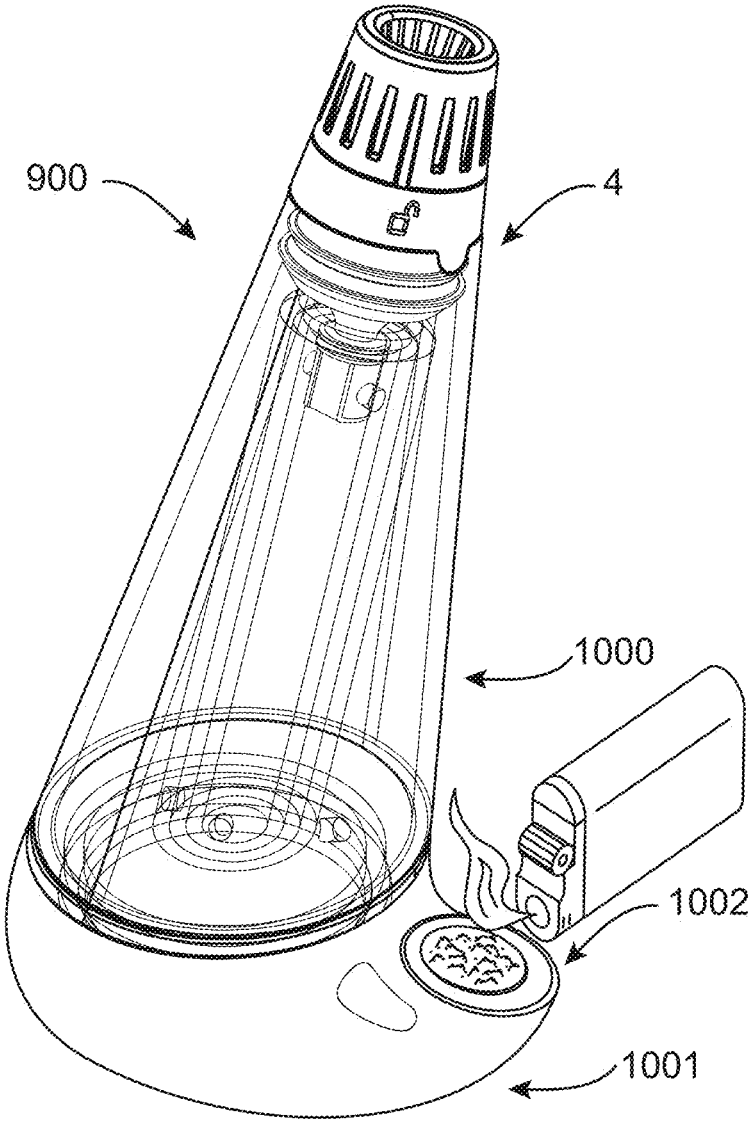
FIG. 18 shows a perspective view of an embodiment of the mouthpiece of FIGS. 1A-1B as used in combination with a pipe for combustion of a substance.

Aspects of the invention as described herein are directed to an improved transportable mouthpiece for use in inhaling a gas, such as a gas formed from vaporizing, burning or otherwise aerosolizing a product intended for inhalation. According to certain aspects, the mouthpiece may be used with a portable vaporizing device, such as embodiments of the device as shown in FIGS. 1-15, as described in more detail below. According to yet another embodiment, the mouthpiece may be used with any other device capable of generating and/or providing a gas for inhalation, such as a pipe used for combustion of a substance to form the product in gas form, as shown in FIG. 18. In one embodiment, the mouthpiece may be used for the inhalation of vaporizable and/or gaseous substances, including gaseous combustion products, such as aromatic substances, therapeutic substances and/or substances with physiological effects. Examples of such substances can include herbs, such as tobacco, cannabis, lavender, chamomile, and other types of plant material. In one embodiment, a product that can be vaporized, burned and/or aerosolized for inhalation can comprise a cannabinoid, such as for example one or more of cannabidiol (a generally non-psychoactive therapeutic substance) and tetrahydrocannabinol (THC) (a psychoactive therapeutic substance). The product may in some embodiments be in the form of an oil and/or wax (e.g., hash) comprising the product, e.g., as extracted from plant material containing the product, a distillate product, and the product may optionally be provided in combination with carriers or other additives. In some embodiments, the product for inhalation in gas form can comprise the combustion products resulting from igniting and burning a substance, such as an herb, tobacco, or cannabis-containing substance.

Figure 1A:
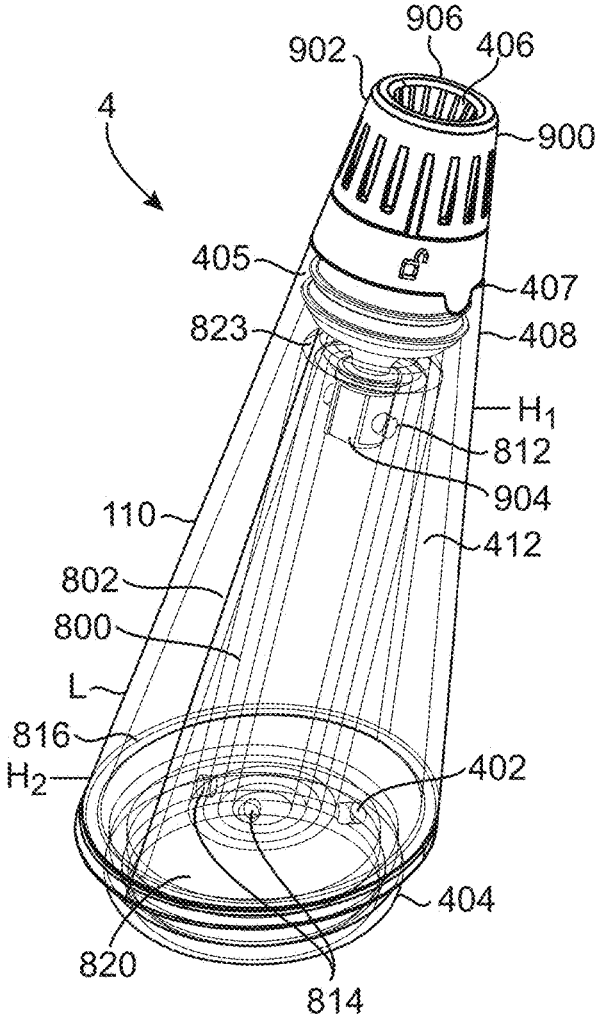
FIGS. 1A-1C show isometric views of an embodiment of a transportable mouthpiece including a sealable attachment piece.
Figure 1B:
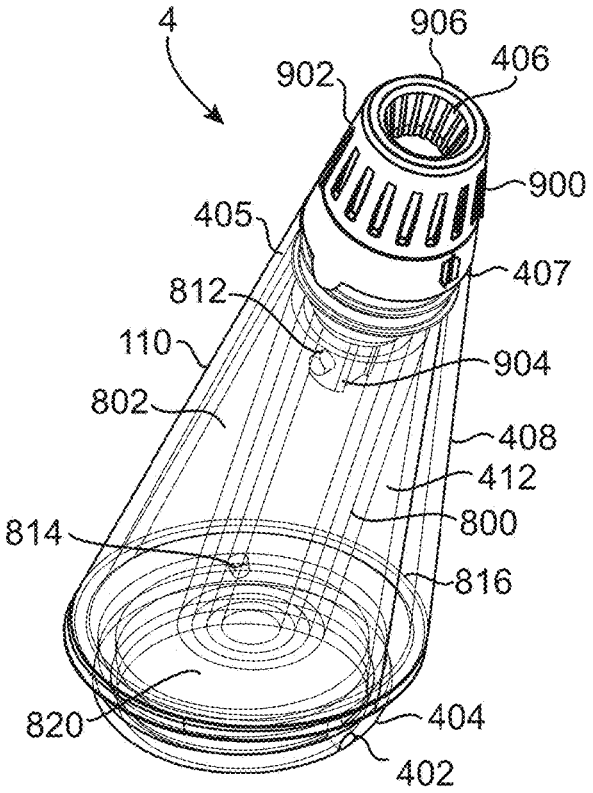
Figure 1C:
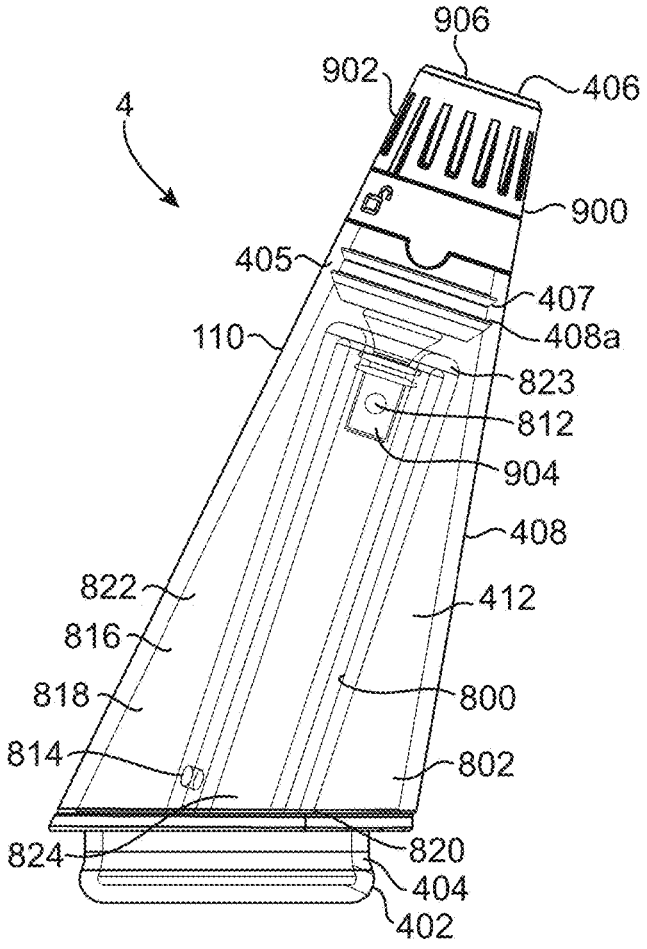

Referring to FIGS. 1A-1C, embodiments of a mouthpiece 4 are shown according to aspects of the disclosure herein, the mouthpiece 4 being suitable for the inhalation by a user of the product in the form of a gas. In one embodiment, the mouthpiece 4 comprises an inhalation outlet 406 through which a user can inhale the product in vapor form. According to certain embodiments, the mouthpiece 4 comprises a mouthpiece housing 408 comprising one or more mouthpiece walls 110 that at least partly define a mouthpiece internal flow path 412 through the mouthpiece housing 408 (see, e.g., FIG. 8B). In certain embodiments, the mouthpiece 4 comprises a first opening 407 at a first end 405 (e.g., an upper region) of the mouthpiece housing 408, and further comprises at least one mouthpiece inlet 402 configured to receive a flow of gas at a second end 404 (e.g., a lower region) of the mouthpiece housing. The gas received by the at least one mouthpiece inlet 402 is passed via the mouthpiece internal flow path 412 to the inhalation outlet 406 for inhalation thereof of the product in gas form.

According to certain embodiments, the mouthpiece 4 comprises an internal gas flow structure 800 that extends into an interior region 802 of the mouthpiece housing 408. For example, the internal gas flow structure 800 may extend generally upwardly from the second end 404 (e.g., a lower region) of the mouthpiece housing, into the interior region, and may in certain embodiments extent to a point just below the first opening 407 of the mouthpiece housing. The internal gas flow structure 800 may, in certain embodiments, generally direct a flow of gas received by the mouthpiece 4 along at least a portion of the internal flow path 412, for example by defining at least a portion of the internal flow path.

Figure 3A:
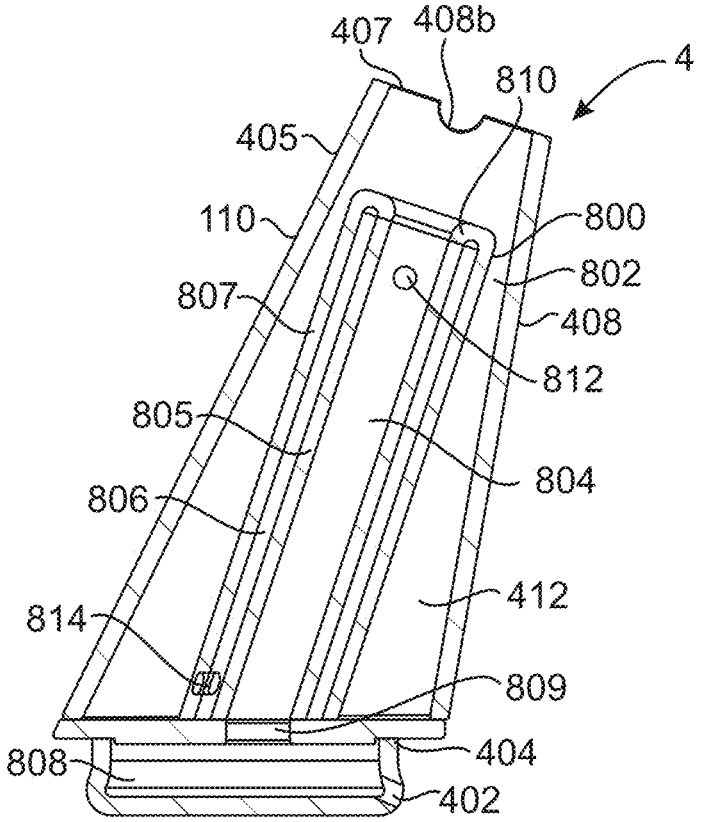
FIGS. 3A-3B are sectional side and sectional isometric views of the mouthpiece housing of FIG. 2.
Figure 3B:
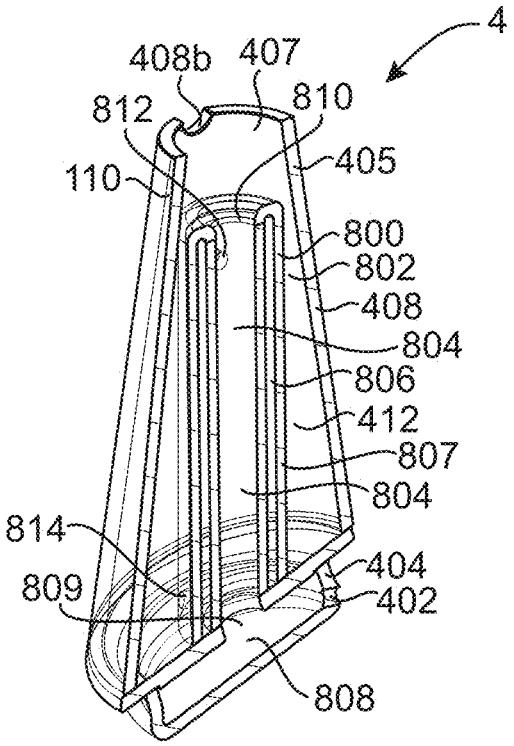

Referring to FIGS. 3A-3B, in one embodiment, the internal gas flow structure 800 comprises a first chamber 804 at least partly defined by at least one first housing 805 that is configured to receive the flow of gas from the at least one mouthpiece inlet 402. For example, in the embodiment as shown in FIGS. 3A-3B, the at least one mouthpiece inlet 402 is configured to provide gas to a gas plenum 808 located at the second end 404 (e.g., bottom region) of the mouthpiece housing 408, which gas plenum 808 is in communication with the first chamber 804 via a port 809. The first chamber 804 further comprises an open end 810 of the first housing 805 at a portion of the internal gas flow structure 800 that is distal to the at least one mouthpiece inlet 402. For example, the open end 810 may be located towards the first end 405 (e.g., upper region) of the mouthpiece housing, and may be below the first opening 407 of the mouthpiece housing. In other embodiments, the open end 810 may be co-located with the first opening 407 of the mouthpiece housing, and/or may be positioned above the first opening 407 of the mouthpiece housing.

Figure 7A:
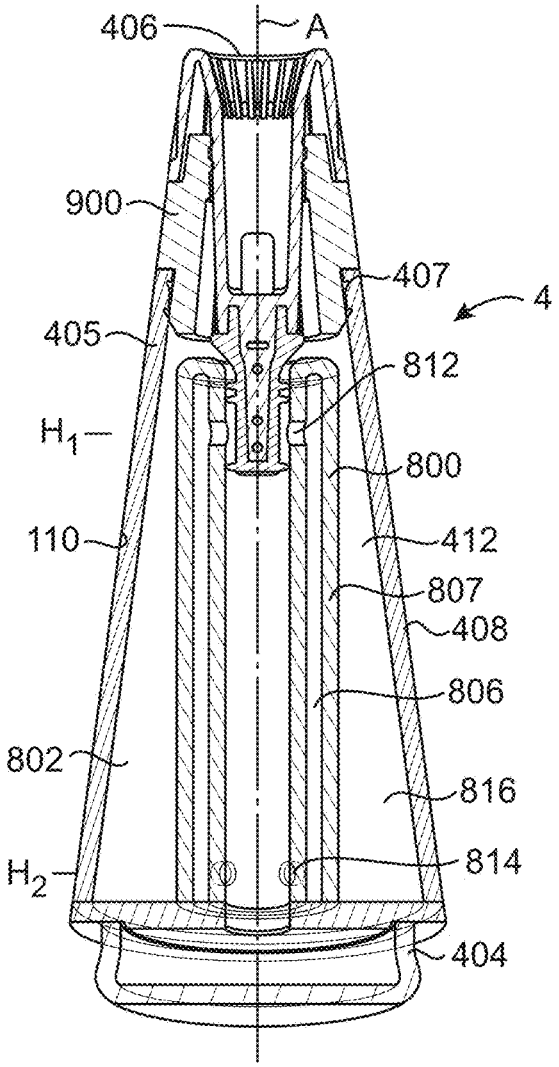
FIGS. 7A-7B are a sectional side view and cross-sectional view of an embodiment of mouthpiece including the sealable attachment piece, where the upper and lower sealing portions of the sealable attachment piece are in a closed state.
Figure 7B:
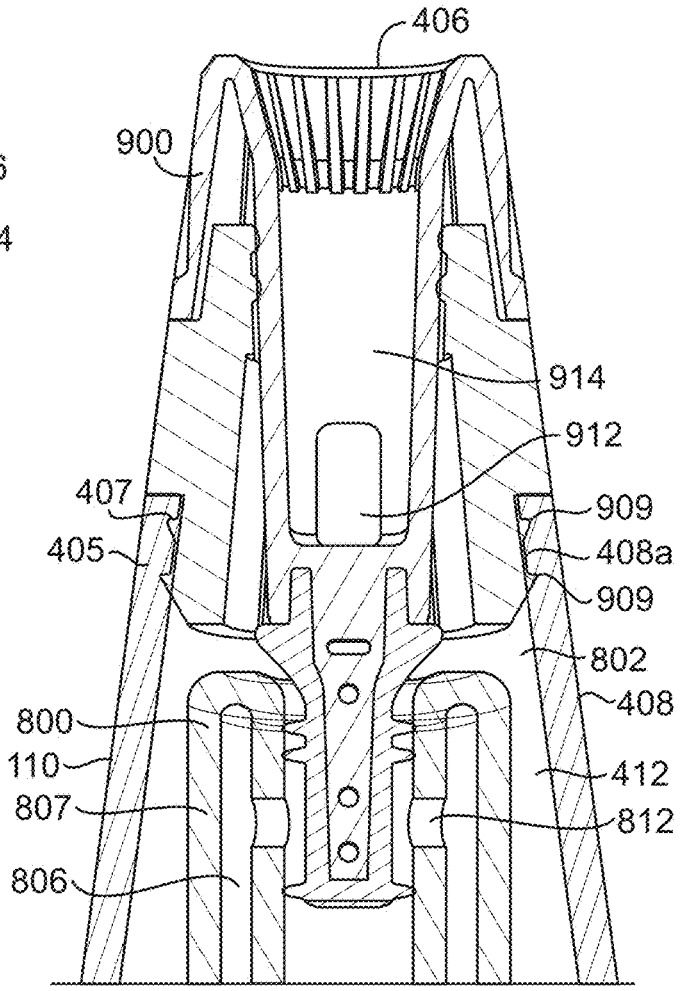

According to certain embodiments, the first housing 805 at least partly defining the first chamber 804 further comprises at least one first aperture 812 formed therein. The at least one first aperture 812 is capable of passing the gas received into the first chamber 804 therethrough, such as for example to form at least a portion of the mouthpiece internal flow path 412. In the embodiment as shown in FIGS. 7A-7B, the first housing 805 comprises two first apertures 812 formed at opposing sides of the housing 805, although other configurations and arrangements of the apertures 812 may also be provided, including just a single first aperture 812 or a multitude of apertures 812. Furthermore, in the embodiment as shown in FIGS. 7A-7B the first apertures 812 are located at a region of the first housing 805 that is distal to the at least one mouthpiece inlet, and below the open end 810 of the first chamber. In other embodiments, one or first apertures 812 may be located at varying distances and/or positions along the first housing, according to a gas flow to be provided through the internal gas flow structure 800.

Referring again to FIGS. 3A-3B, according to certain embodiments, the internal gas flow structure 800 comprises a second chamber 806 that is at least partly defined by at least one second housing 807 that is configured to receive the flow of gas via the at least one first aperture 812 from the first chamber 804, and direct the flow of gas towards at least one second aperture 814. That is, according to certain embodiments, the at least one first aperture 812 forming in the first housing connects the first and second chambers 804, 806, to allow a flow of gas therethrough, such that a gas received in the first chamber 804 from the at least one mouthpiece inlet 402 is passed to the second chamber 806 via the at least first aperture 412.

Referring to the embodiments as shown in FIGS. 7A-7B, the at least one second aperture 814 may be formed in the at least one second housing 807 at least partly defining the second chamber 806. Similarly to the at least one first aperture 812, the at least one second aperture 814 can comprise various different number, configurations and arrangements, such as at least two apertures 814 formed in the second housing 807 at a same side of the housing, as depicted in the embodiment shown in FIG. 7A, and/or just a single aperture 814 or a multitude of apertures 814. Furthermore, in the embodiment as shown in FIGS. 7A-7B the second apertures 814 may be located at a region of the second housing 807 that is distal to the at least one first aperture 812, such as at a lower region of the second chamber 806. In other embodiments, one or second apertures 814 may be located at varying distances and/or positions along the second housing, according to a gas flow to be provided through the internal gas flow structure 800.

In one embodiment, the at least one second aperture 814 is located at a region of the second chamber 806 that is below the at least one first aperture 812, such that a flow of gas received from the at least one first aperture 812 into the second chamber is directed in a downward direction towards the at least one second aperture 814. That is, the second housing 807 may at least partly direct the received flow gas in a direction towards the at least one second aperture located towards a lower end of the second chamber. Such a configuration may be suitable, for example, when the second chamber 806 is at least partly filled with water, such that gas entering the second chamber 806 from the first aperture 812 can enter at a region of the second chamber that is above a level of water in the second chamber 806, and can be made to pass through the water held in the second chamber 806 and to the at least one second aperture 814, to provide cooling and/or filtering of the gas by the water held in the second chamber 806. That is, referring to FIG. 7A, the at least one first aperture 812 may be located at a height $H_1$ along a longitudinal axis A of the mouthpiece that is greater than a height $H_2$ of the at least one second aperture 814 as measured from a lowest point of the second end 404 of the mouthpiece housing.

Referring again to FIGS. 1A-1C, according to certain embodiments, the mouthpiece 4 further comprises a main chamber 816 that is at least partly defined by the mouthpiece housing 408. The main chamber 816 is configured to receive the flow of gas exiting the second chamber 806 via the at least one second aperture 814, and the gas received into the main chamber 816 is directed towards the first opening 407 at the first end 405 of the mouthpiece housing 405, such that the main chamber 816 forms at least a portion of the mouthpiece internal flow path 812. According to one embodiment, the main chamber 816 may, similarly to the second chamber 806, be capable of being at least partly filled with water at a lower region thereof, such as for cooling and/or filtering of the gas received from the second chamber 406 via the at least one second aperture 814, and passing through the main chamber 816. The at least one second aperture 814 may also be positioned so as to allow a flow of water between the second chamber 806 and main chamber 816, such that at least partly filling the main chamber 816 also at least partly fills the second chamber 806. That is, water may be provided to the main chamber and/or second chamber such that the level of water L exceeds a height $H_2$ of the at least one second aperture 814, to provide fluid communication between the chambers. Thus, in certain embodiments, a gas received in the first chamber 804 and passed to the second chamber 806 is passed into a reservoir of water held in the second chamber 806, through the at least one second aperture 814 at a height below the level L water in the second chamber, and through a reservoir of water held in the main chamber 816, with the flow of gas exiting the reservoir of water held in the main chamber at a point above the at least one second aperture and being directed towards the first opening 807 at the first end 805 of the mouthpiece housing.

Figure 8A:
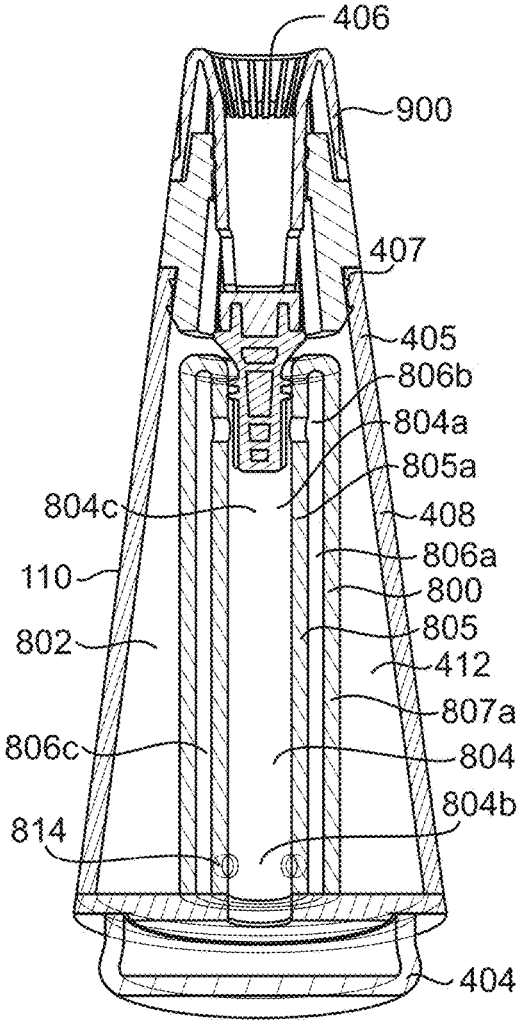
FIGS. 8A-8B are a sectional side view and cross-sectional view of an embodiment of mouthpiece including the sealable attachment piece, where the upper and lower sealing portions of the sealable attachment piece are in an open state.

According to one embodiment, as shown in FIGS. 1A-1C, 2, 3A-3B, 7A-7B and 8A-8B, the first and second chambers 804, 806 of the internal gas flow structure 800 respectively comprise an inner cylindrical chamber 804*a* at least partly defined by a first cylindrical housing 805*a*, and an outer cylindrical chamber 806*a* at least partly defined by both the first cylindrical housing 805*a* and a second cylindrical housing 807*a* that is radially external to the first cylindrical housing 805*a*, and wherein the at least one first aperture 812 is formed in the first cylindrical housing 805*a* so as to place the inner and outer cylindrical chambers 804*a*, 806*a* in communication with one another (see, e.g., FIG. 8A). According to one such embodiment, the flow of gas is received by the inner cylindrical chamber 804*a* at a bottom portion 804*b* of the inner cylindrical chamber from the mouthpiece inlet 402. The first cylindrical housing 805*a* can be configured to direct the flow of gas towards an upper portion 804*c* of the inner cylindrical chamber where the at least one first aperture 812 is disposed in the first cylindrical housing 805*a*. According to yet a further embodiment, the flow of gas from the inner cylindrical chamber 804*a* is received by the outer cylindrical chamber 806*a* at an upper portion 806*b* thereof, and wherein the first and second cylindrical housings 805*a*, 807*a* direct the flow of gas downwardly through the outer cylindrical chamber 806*a* and towards the at least one second aperture 814 located towards a bottom portion 806*c* of the outer cylindrical chamber 806*a*.

According to one embodiment, as shown in FIGS. 1A-1C, 2, 3A-3B, 7A-7B and 8A-8B, the main chamber 816 that is at least partly defined by the mouthpiece housing is external to, and at least partly surrounds, the internal gas structure 800. For example, according to one embodiment, the main chamber 816 is radially external to and at least partly surrounds the inner and outer cylindrical chambers 804*a*, 806*a*. According to a further embodiment, the mouthpiece housing at least partly defining the main chamber 816 is configured to direct the gas received via the at least second aperture 814 towards the inhalation outlet 406, where the inhalation outlet is located at a position above the inner cylindrical chamber 804*a*

In certain embodiments, the main chamber 816 and/or second chamber 806 may further be defined by a bottom portion of the mouthpiece housing 408 that forms a lower surface of one or more of the main chamber 816 and second chamber 806. For example, the mouthpiece housing 408 can comprise a lower wall 820 that separates one or more of the main chamber 816 and/or second chamber 806 from the plenum chamber where gas is received from the mouthpiece inlet. The lower wall 820 may thus, in certain embodiments, serve to at least partly the main chamber in combination with the sidewalls 110 of the mouthpiece housing. The lower wall 820 may also in certain embodiment serve to at least partly define the second chamber 806 in combination with the first and second housings 805, 807, and an upper wall 822 of the second chamber 806. The main chamber 816 and second chamber 806 may also have different lower walls at different respective heights to one another. The main chamber 816 and second chamber 806 may thus be at least partly filled with water during operation of the mouthpiece, with the water being retained in the main chamber and/or second chamber by the enclosures formed by the lower wall(s) of these chambers and the respective chamber housings defining the chambers. That is, in certain embodiments the main chamber 816 can be understood to contain a first water reservoir 822 configured to retain water in a lower portion 818 thereof, and the second chamber 806 can be understood to contain a second water reservoir 824 configured to retain water in a lower portion 806 thereof, where the first and second water reservoirs are in communication with one another via the at least one second aperture 814.

Referring to FIGS. 1A-1C and 4A-4C, in one embodiment, the mouthpiece 4 further comprises a sealable attachment piece 900 that is configured to at least partly seal a portion of the internal flow path 412 within the mouthpiece housing 408. According to certain embodiments, the sealable attachment piece 900 may be releasably removable from the mouthpiece housing 408, such that the sealable attachment piece 900 can be removed from the mouthpiece housing for cleaning, refurbishment and/or replacement of the sealable attachment piece 900 and/or mouthpiece housing 408. According to yet another embodiment, the sealable attachment piece 900 may be made integral with the mouthpiece housing 408 such that the attachment piece 900 and mouthpiece are effectively a unitary body.

According to one embodiment, the sealable attachment piece 900 comprises an upper sealing portion 902 that is configured to be inserted into the first opening 407 of the mouthpiece housing 408. The upper sealing portion 902 may be configured to be transitioned between an open state in which gas is allowed to flow through the inhalation outlet

406, and a closed state in which gas is blocked from flowing through the inhalation outlet 406. Embodiments of the sealable attachment piece 900 can further comprise a lower sealing portion 904 that is configured to be inserted into the open end 810 of the internal gas flow structure 800. The lower sealing portion 904 may be configured to be transitioned between an open state in which gas is allowed to flow through the at least one first aperture 812 connecting the first and second chambers, 804, 806 and a closed state in which gas is blocked from flowing through the at least one first aperture 812 between the first and second chambers 804, 806. The sealable attachment piece 900 can further comprise an activating member 906 configured to transition the upper and lower sealing portions between the open and closed states upon activation thereof. For example, the activating member 906 may be capable of simultaneously transitioning the upper and lower sealing portions between the open and closed states, such that the flow of gas is simultaneous stopped at the upper and lower sealing portions, or simultaneously allowed to flow at the upper and lower sealing portions, according to the activation state of the activating member 906.

According to one embodiment, in a case where the upper sealing portion 902 and lower sealing portion 904 are in their respective closed states, the portion of the mouthpiece internal flow path 412 between the at least one first aperture 812 and the inhalation outlet 406 is sealed to trap any gas and/or water therebetween. According to the embodiment, in a case where the upper sealing portion and lower sealing portion are in their respective open states, the portion of the mouthpiece internal flow path between the at least one first aperture 812 and the inhalation outlet 406 is open to allow a flow of gas and/or water therethrough. That is, then the activating member 906 transitions the sealing portions to the closed states, any water and/or gas that might be in the mouthpiece housing is stopped from leaking through the inhalation outlet 406 by the upper sealing portion, and is simultaneously stopped from leaking through the at least one first aperture 812 (and thus preventing leakage out of the mouthpiece inlet 402 in communication with the first chamber having the at least one first aperture) by the lower sealing portion. When the activating member 906 transitions the sealing portions to the open states, the internal gas flow path is again open to allow gas received from the mouthpiece inlet 402 to pass through the internal gas flow structure 800 into the main chamber 816 and out of the inhalation outlet 406. Accordingly, the sealable attachment piece may, in certain embodiments, allow for ready and convenient transport of the mouthpiece 4, even in a case where some amount of water or residue remains in the mouthpiece housing 408, as the internal flow path can be sealed via a single activation that simultaneously blocks exit from both the inlet and outlet to the mouthpiece housing.

Figure 8B:
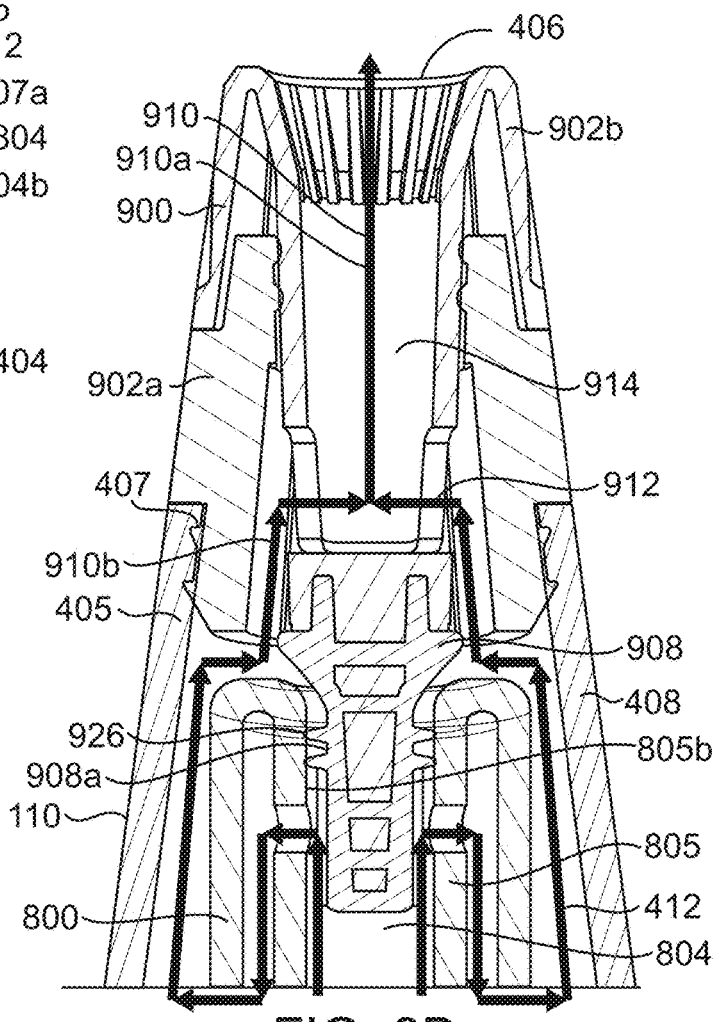
Figure 9A:
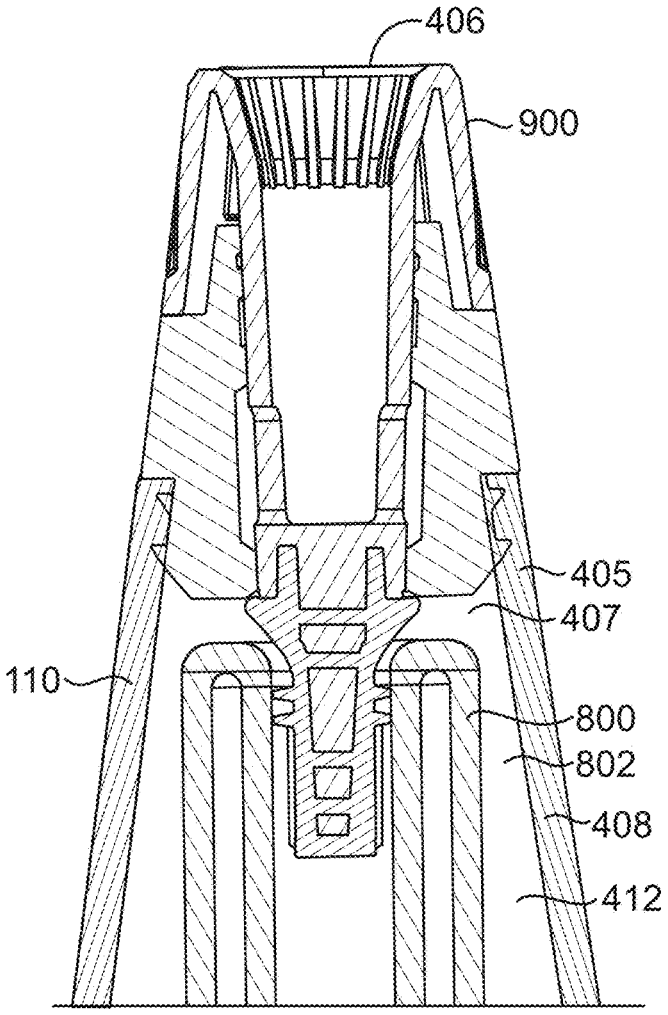
FIGS. 9A-9B are a sectional side view and cross-sectional top view of the mouthpiece including the sealable attachment piece, where the upper and lower sealing portions of the sealable attachment piece are in a closed state.
Figure 9B:
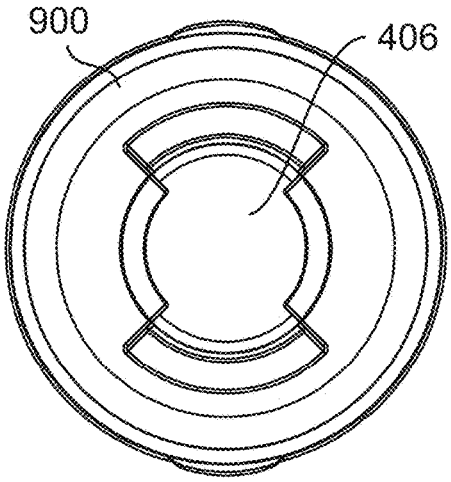
Figure 10A:
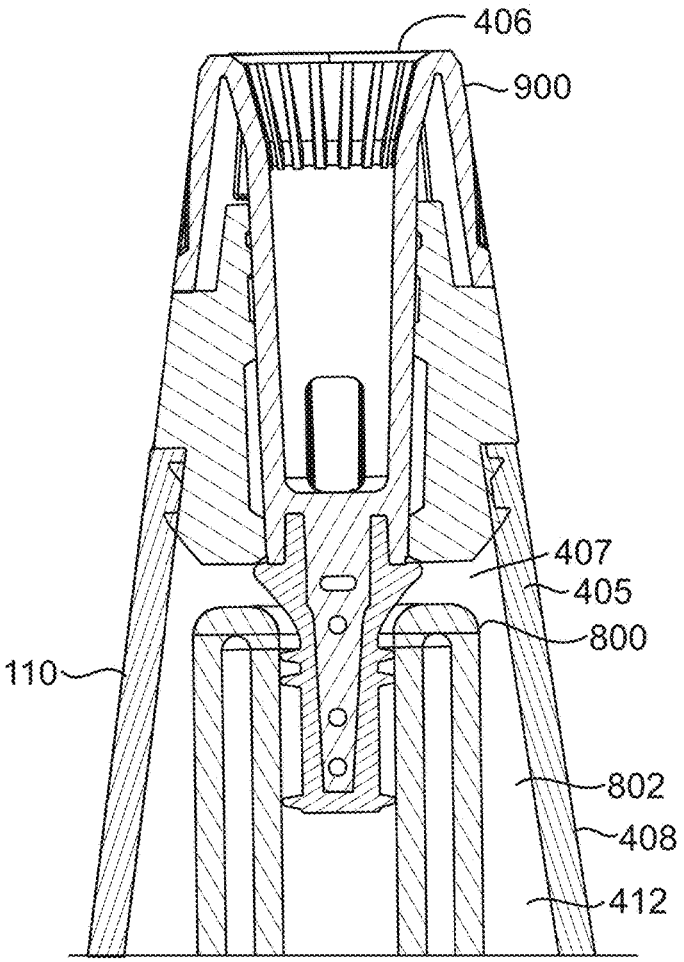
FIGS. 10A-10B are a sectional side view and cross-sectional top view of the mouthpiece including the sealable attachment piece, where the upper and lower sealing portions of the sealable attachment piece are in an open state.
Figure 10B:
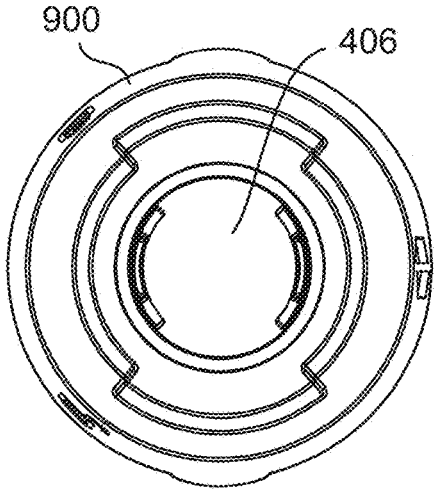

Referring to FIGS. 1A-1B and 8B, according to one embodiment, the lower sealing portion 904 is configured to seal the open end 810 of the first chamber 804 in the internal gas flow structure 800, so as to form a portion of the internal flow path 812 extending from the gas flow inlet 402 to the second chamber 806. For example, in an embodiment where the first and second chambers comprising inner and outer cylindrical chambers 804*a*, 806*a*, the first cylindrical housing 805*a* can comprise the open end 810 of the inner cylindrical chamber 804*a* at an end of the first cylindrical housing 805*a* that distal to the mouthpiece inlet 402. Accordingly, in this embodiment, insertion of the lower sealing portion 904 of the sealable attachment piece 900 into the open end 810 seals the open end of the first cylindrical housing to direct gas received from the mouthpiece inlet and passing through the inner cylindrical chamber into the outer cylindrical chamber via the at least one first aperture 812 formed in the first cylindrical housing 805*a*.

Figure 4A:
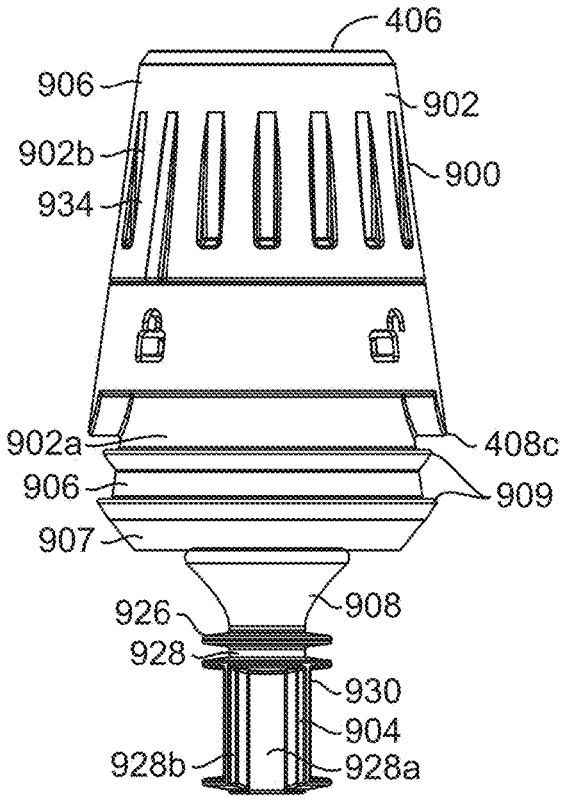
FIGS. 4A-4C are side views of an embodiment of a sealable attachment piece, an embodiment of an upper cap portion with shaft of the sealable attachment piece, and an embodiment of a plug portion of the sealable attachment piece.
Figure 4B:
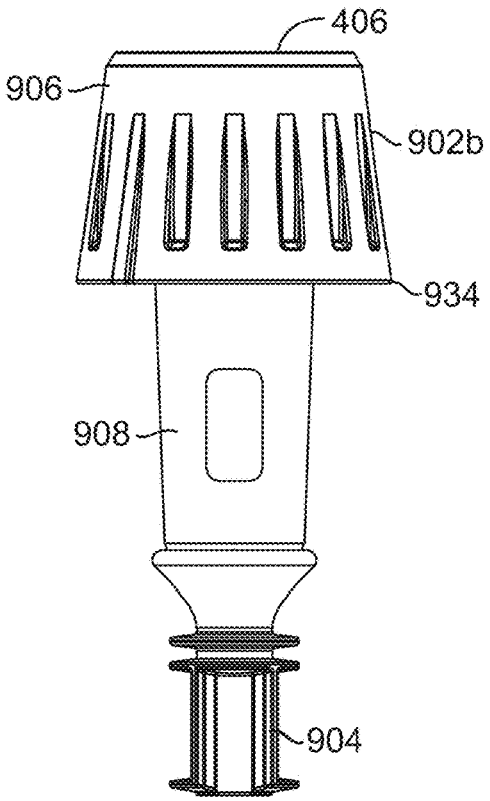
Figure 4C:
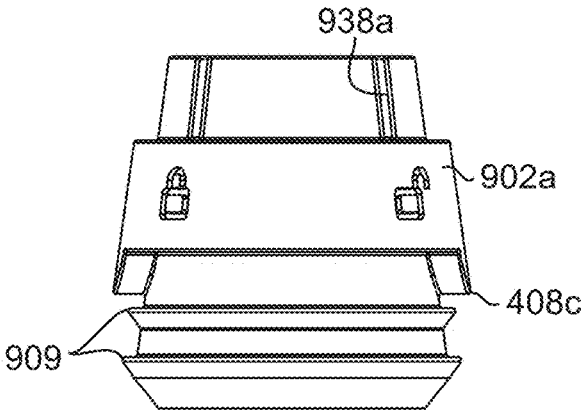

Referring to FIGS. 4A-4C, in one embodiment, sealable attachment piece 900 comprises an upper sealing portion 902 comprising a plug portion 902*a* and an upper cap portion 902*b* that is in communication with a shaft 908 extending from the upper cap portion 902*b* to the lower sealing portion 904. According to one embodiment, the plug portion 902*a* comprises one or more annular sealing rings 906 about a circumference thereof on an outer surface 907 of the plug portion, to form a seal with an inner surface 408*a* of the mouthpiece housing 408 in a region proximate to the first opening 407 at the first end 405 of the mouthpiece housing when the plug portion is at least partly inserted into the first end 405 of the mouthpiece housing (see, e.g., FIG. 7B). According to yet other versions, the plug portion could comprise a different configuration, such as a plug portion that extends over an outer surface of the mouthpiece housing as opposed to being at least partly inserted inside the mouthpiece housing as in the embodiments as shown. In an embodiment where the plug portion fits over the mouthpiece housing, the annular sealing rings could be formed circumferentially about an internal surface of the plug portion, so as to engage an outer surface of the mouthpiece housing in a region of the first opening. That is, the plug portion 902*a* is capable of engaging and forming a seal with a surface of the mouthpiece housing so as to retain the plug portion on the mouthpiece housing. In one embodiment, the upper cap portion 902*b* and at least a portion of the shaft 908 extending therefrom are formed of a relatively hard plastic material, such as polycarbonate. In a further embodiment the plug portion 902*a* is formed of a relatively flexible and conformable sealing material, such as a silicone material. Other sealing features provided on the upper and lower sealing portions and described further herein, such as annular sealing rings, finned windows with sealing fins, etc., may similarly be formed of a conformable sealing material to form a seal with a surface engaged by the sealing feature, such as a silicone material.

Figure 2:
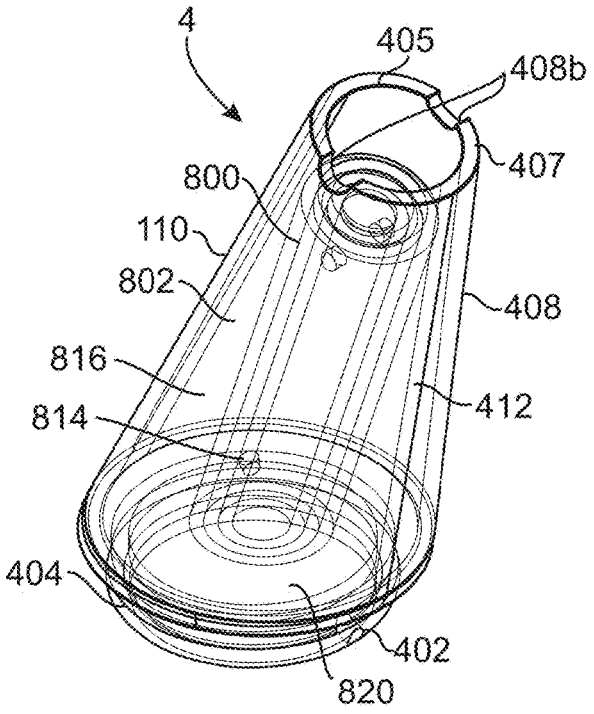
FIG. 2 is an isometric view of an embodiment of a mouthpiece housing.

Referring to FIGS. 2 and 3A-3B, according to one embodiment, the mouthpiece housing 408 comprises one or more registration features 408*b* to register and secure a circumferential position of the plug portion 902*a* when the sealable attachment piece 900 is attached to the mouthpiece housing 408. For example, the one or more registration features can comprise one or more notches or other features formed in an upper surface of the mouthpiece housing to secure the plug portion 902*a*, for example by securing complementary registration features 408*a* of the plug portion (see, e.g. FIG. 1C).

According to one embodiment, the upper cap portion 902*b* may be capable of moving independently of the plug portion 902*a* so as to act as the activating member 906 that simultaneously transitions the upper and lower sealing portions between closed and open states. In one embodiment, the upper cap portion 902*b* is rotatable independently of the plug portion 902*a* to act as the activating member that activates the transition between the open and closed states of the upper and lower sealed portions. In another embodiment, the upper cap portion 902*b* is translatable independently of the plug portion 902*a* to act as the activating member that activates the transition between the open and closed states of the upper and lower sealed portions, and thereby act as the activating member. For example, the upper cap portion 902*b* may be translatable a predetermined distance along the longitudinal axis A of the mouthpiece 4.

Figure 5A:
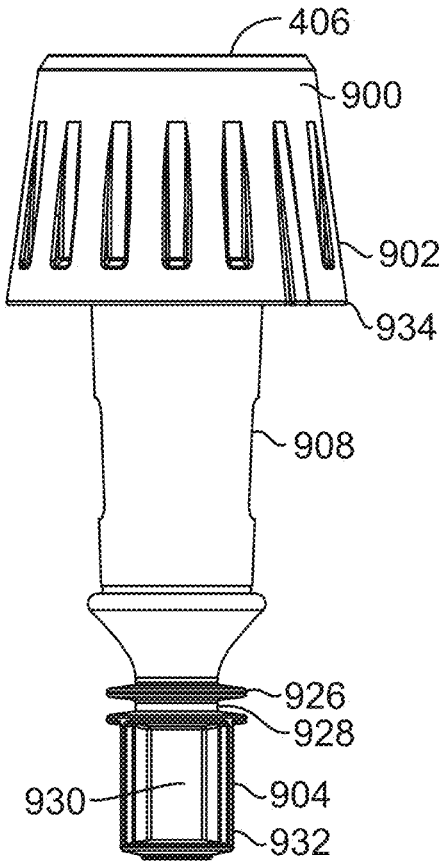
FIGS. 5A-5B are a side view and sectional view of an embodiment of the upper cap portion with shaft of the sealable attachment piece.
Figure 5B:
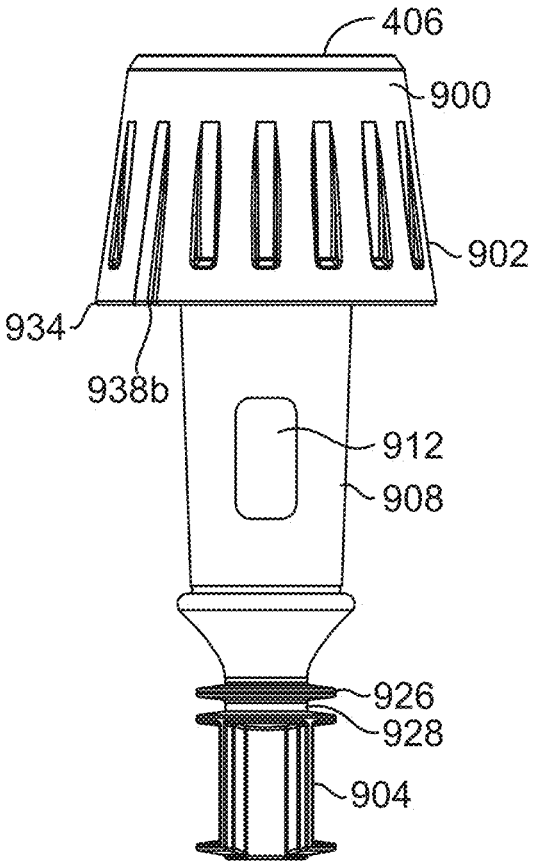

Referring to FIGS. 5A-5B and 8B, according to one embodiment, the upper sealing portion 902 comprises one or more gas channels 910 formed in the plug portion 902*a* and/or upper cap portion 902*b* to facilitate a flow of gas from the main chamber 816 of the mouthpiece to the inhalation outlet 406. In the embodiment as shown, the upper cap portion 902*b* comprises an opening corresponding to the inhalation outlet 406 at an upper end thereof. The one of more channels 910 passing through the upper sealing portion 902 can, in certain embodiments, comprise one or more ports 912 formed in the shaft 908 extending from the upper cap portion 902*b*. In this embodiment, the shaft 908 can comprise a hollow portion 914 therein forming an inner gas channel 910*a* between the one or more ports 912 and the inhalation outlet 406. The one or more ports 912 communicate with outer gas channels 910*b* formed in the spaces between the inner surface of the plug portion 902*a* and an exterior surface of the shaft 908. That is, according to one embodiment, at least a portion of the plug portion 902*a* circumferentially surrounds the shaft 908 at a portion thereof where the one or more ports 912 are formed, and is capable of forming the outer gas channels 910 external to the shaft 908 and leading to the main chamber 816. Accordingly, gas entering the upper sealing portion 902 from the main chamber 816 of the mouthpiece housing passes can pass through the one or more outer gas channels 910*b* formed between the plug portion and shaft, through the one or more ports 912 into the inner channel 910*a* formed by the hollow portion of the shaft, and through the inhalation outlet 406 (see, e.g., FIG. 8B). In the embodiment as shown in FIG. 8, the one or more ports are on opposing sides from one another on the shaft 908, and other configurations can also be provided. The plug portion 902*a* can further comprise one or more annular sealing rings 922 on an inner surface 916 at an upper end 920 thereof, which are configured to engage with an outer surface of the shaft 908 to form a seal with the shaft at the upper end 920 of the plug portion.

In one embodiment, at least a portion of the plug portion 902*a* circumferentially surrounds the shaft 908 at a portion thereof where the one or more ports 912 are formed, and the inner surface 916 of the plug portion 902*a* comprises circumferentially disposed sealing regions 918*a* and non-sealing regions 918*b* configured to engage with the one or more ports 912. In one embodiment, when the non-sealing regions 918*b* of the plug portion 902*a* are engaged with one or more of the ports 912, one or more of the gas flow channels 910 is open to pass through the upper sealing portion 902 to the inhalation outlet 406, and when the sealing regions 918*a* are engaged with one or more of the ports 912, the one or more gas flow channels 910 are closed to prohibit a flow of gas through the upper sealing portion 902 to the inhalation outlet 406. In another embodiment, the inner surface 916 of the plug portion 902*a* comprises sealing and non-sealing regions 918*a*, 918*b* is configured to engage with the one or more ports 912, the sealing and non-sealing regions being longitudinally disposed along the inner surface 916 of the plug portion. In certain embodiments, the circumferentially disposed sealing and non-sealing regions of the plug portion are engaged via rotation of the upper cap portion 902*b* to rotate the one or more ports 912 about the axis of the shaft 908 to engage with the one or more sealing and non-sealing regions 918*a*, 918*b*. In other embodiments, the longitudinally disposed sealing and non-sealing regions of the plug portion are engaged via translation of the upper cap portion 902*b* to translate the one or more ports on the shaft 908 longitudinally with respect to the plug portion 902*a*, to engage with the one or more sealing and non-sealing regions on the inner surface of the plug portion 902*a*.

Figure 6A:
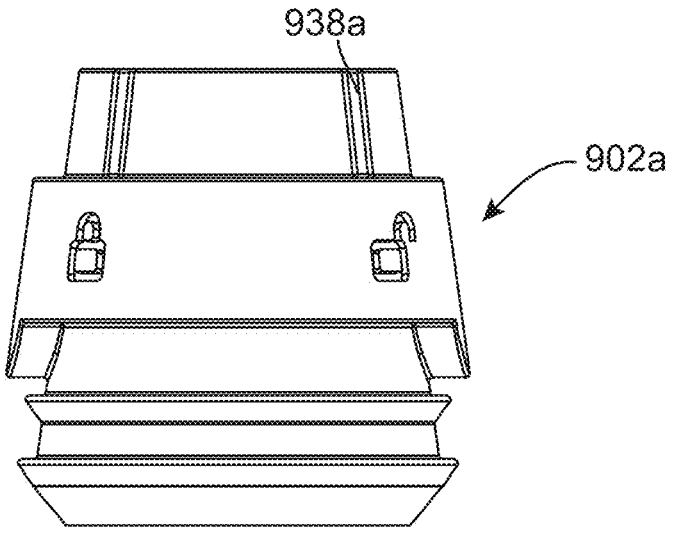
FIGS. 6A and 6B are a side view and sectional view of an embodiment of the plug portion of the sealable attachment piece.
Figure 6B:
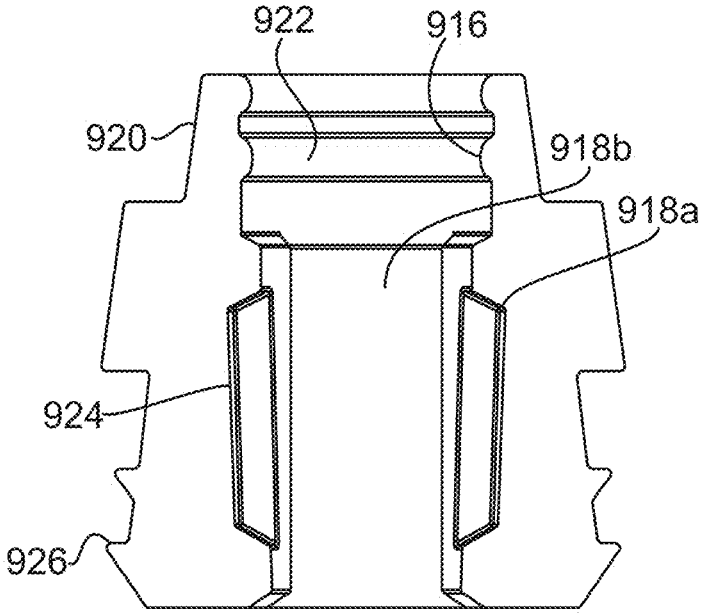

Referring to FIG. 6B, in one embodiment, the sealing regions 918*a* comprise finned windows 924 comprising flexible sealing material, the finned windows comprising sealing fins 926 that extend from the inner surface 916 of the plug portion 902*a* and are capable of forming a seal about the one or more ports 912 formed in the shaft 308, such that gas entering one or more gas flow channels 910 at a lower end of the upper sealing portion 902 is blocked from entering the one or more ports 912 formed in the shaft 908 and prevented from being passed to the inhalation outlet 406. In further embodiments, the non-sealing regions 918*b* of the inner surface 916 of the plug portion 920 can comprise the one or more outer channels 910*b* configured to pass the flow of gas from the mouthpiece main chamber 816 and to the one or more ports 912 in the shaft 908, to flow the gas to the inhalation outlet 406, in a case where the non-sealing regions 918*b* of the plug portion 902*a* are engaged with the ports 912.

Referring to FIGS. 4A-4B, 5A-5B and 8B, according to one embodiment, the sealable attachment piece 900 comprises a lower sealing portion 904 that comprises one or more annular sealing rings 926 disposed on a lower portion 928 of the rotatable shaft 908, the one or more sealing rings 926 being configured to form a seal with a surface of the first housing 805 of the first chamber 804 in a region of the open end 810 of the first chamber 804 to form at least a portion of the gas flow path 412 directing the gas received through the mouthpiece inlet 402 to the at least one first aperture 812 connecting the first and second chambers 804, 806. For example, the one or more sealing rings 926 may extend from an outer surface 908*a* of the shaft and engage an inner surface 805*b* of the first housing 805 just above the at least one first aperture 812. The one or more sealing rings 926 may be configured to block the open end 810, such that gas is prevented from passing therethrough, and is instead directed to the at least one first aperture 812.

According to one embodiment, the lower sealing portion 904 comprises a lower region 928 of the shaft 908 comprising one or more lower sealing regions 928*a* and lower non-sealing regions 928*b* circumferentially disposed about an outer surface 908 of the lower region 928 of the shaft. According to one embodiment, the one or more sealing regions and/or non-sealing regions 928*a*, 928*b* are engaged with the at least one first aperture 812 via rotation of the rotatable shaft 908, such that when the sealing regions 928*a* are engaged with the at least one first aperture 812, the at least one first aperture 812 is closed to prohibit a flow of gas and/or liquid therethrough, and when the non-sealing regions 928*b* are engaged with at least one first aperture 812, the at least one first aperture 812 is open to permit a flow of gas therethrough from the first chamber to the second chamber. For example, according to embodiments herein, the upper and lower sealing portions 902, 904 can be simultaneously engaged via rotation of the upper cap portion. According to yet another embodiment, the lower region of the shaft comprises one or more lower sealing regions and lower non-sealing regions disposed longitudinally along an outer surface of the lower region of the shaft, wherein the one or more sealing regions and/or non-sealing regions are engaged with the at least one first aperture via translation of the shaft. For example, according to embodiments herein, the upper and lower sealing portions 902, 904 can be simultaneously engaged via rotation of the upper cap portion.

According to one embodiment, the sealing regions 928*a* of the lower sealing portion comprise finned windows 930 comprising flexible sealing material, the finned windows comprising sealing fins 932 that extend from the outer surface 908*a* of the shaft 908 and are capable of forming a seal about the at least one first aperture 812 formed in the first housing, such that gas and/or liquid is prevented from flowing through the at least one aperture 812 between the first and second chambers.

Referring to FIGS. 4A-4C, in one embodiment, the upper cap portion 902*b* comprises a lip portion 934 at an upper end thereof that is configured to be fitted over a top portion of the plug portion 902*a* to retain the upper cap portion 902*b* over the plug portion 902*a*. According to yet another embodiment, the plug portion 902*a* can comprise rotation registration features 938*a* on an external surface thereof configured to engage with complementary features 938*b* on an inner surface of the lip portion 934 of the upper cap portion 902*b*, so as to allow for a predetermined arc of rotation of the upper cap portion 902*b* to provide for a predetermined rotation of the shaft and engagement and/or disengagement of the sealing and non-sealing regions of the upper sealing portion and/or lower sealing portion of the sealable attachment piece. For example, referring to FIGS. 5B and 6A, the complementary features 938*b* on the inner surface of the upper cap portion 902*b* can comprise interference ribs that engage with features 938*a* comprising complementary ribs on the external surface of the plug portion 902*a*. According to another embodiment, the plug portion can comprises translation registration features on an external surface thereof configured to engage with complementary features on an inner surface of the lip portion of the upper cap portion so as to allow for a predetermined length of translation of the upper cap portion to provide for a predetermined translation of the shaft and engagement and/or disengagement of the sealing and non-sealing regions of the upper sealing portion and/or lower sealing portion of the sealable attachment piece.

Referring to FIGS. 7A-7B and 9A-9B, embodiments of the mouthpiece are shown where the sealable attachment piece 900 is closed, meaning that both upper and lower sealing portions are closed, so as to prevent a flow of gas and/or water into or out of the mouthpiece housing. Referring to FIGS. 8A-8B and 10A and 10B, embodiments of the mouthpiece are shown where the sealable attachment piece 900 is open, meaning that both upper and lower sealing portions are open, so as to allow a flow of gas and/or water into or out of the mouthpiece housing.

According to one embodiment of the disclosure, a method of using the mouthpiece described herein is provided. Embodiments of the method can generally comprise providing a volume of water to the mouthpiece housing to at least partially fill the main chamber and flow into the second chamber, and adjusting the activating member to set the upper and lower sealing portions, respectively, in their open states. A gas is introduced into the mouthpiece housing that is formed from a product intended for inhalation into the mouthpiece inlet, and passed through the internal gas flow path to the mouthpiece inhalation outlet. The flow of gas passing through the mouthpiece is inhaled via the inhalation outlet. The flowing of a gas through the mouthpiece and inhalation via the inhalation outlet can be repeated according to preferred use. Once an amount of gas has been inhaled, for example if a user wishes to end the inhalation session, the activating member can be adjusted to set the upper and lower sealing portions, respectively, in their closed states, for example if the user wishes to transport the mouthpiece or store the mouthpiece after use without risk of leakage.

Aspects of the disclosure herein further provide for a method of fabricating the mouthpiece described herein. Embodiments of such a method of fabrication can comprise providing the mouthpiece housing having the internal gas flow structure with the first chamber having the open first end, and at least one first aperture, and having the first opening at the first end thereof; providing the sealable attachment piece having the upper and lower sealing portions; inserting the sealable attachment piece into the first opening of the mouthpiece housing such that the lower sealing portion at least partly seals the open first end of the first chamber of the internal gas flow structure, to form at least a part of the internal gas flow path that directs gas through the at least one first aperture, and such that the upper sealing portion is sealed to a region of the mouthpiece housing about the first opening.

The mouthpiece 4 as described herein may be used with any suitable device or apparatus that is capable of providing a gas to the mouthpiece 4, such as a portable vaporizing device that provides a gas vapor to the inlet of the mouthpiece for inhalation thereof. The transportable mouthpiece 4 may also have the advantage that it can be readily switched between devices without excessive leakage therefrom, due to the sealing capabilities provide by the sealable attachment pieces.

Accordingly, an embodiment of a portable vaporizing device that may be suitable for use with the transportable mouthpiece 4 is described below with reference to FIGS. 11-17, however it is understood that the use of the mouthpiece 4 is not limited to use with the device described herein, and the device is being described for illustrative purposes only. For example, the transportable mouthpiece 4 may also be suitable for use with a source of gas emanating from burning and/or combustion of an inhalable product, such as a pipe, or with other vaporizers other than that specifically described herein.

Furthermore, as an alternative to the portable electronic device 1 as shown in FIGS. 11-17, in certain embodiments the mouthpiece 4 having the sealable attachment piece 900 described herein may be provided as a part of a pipe 1000 for the inhalation of the gaseous products produced by combustion of a substance. For example, referring to FIG. 18, a pipe 1000 may comprise a pipe base 1001 that is placed in communication with the mouthpiece 4, and having a receptacle 1002 for receiving a substance that is also suitable for combustion of the substance therein, such as by igniting the substance. The gaseous combustion product produced by burning of the substance can be introduced into the mouthpiece from the pipe base 1001, such as via a conduit within the pipe base that connects to the mouthpiece inlet.

Furthermore, while certain of FIGS. 11-17 depict a device 1 with an embodiment of the mouthpiece 4 that does not include a sealable attachment piece 900, it is to be understood that the embodiment of the mouthpiece with the sealable attachment piece as shown in any of FIGS. 1-10B could be substituted for the embodiment of the mouthpiece shown in any of FIGS. 11-22 for use with the device 1. Furthermore, in some embodiments, features of the mouthpiece 4 as described in the embodiment shown in FIGS. 11-17 may also be incorporated, where suitable, into the embodiment of the mouthpiece as shown in FIGS. 1-10B.

Figure 11:
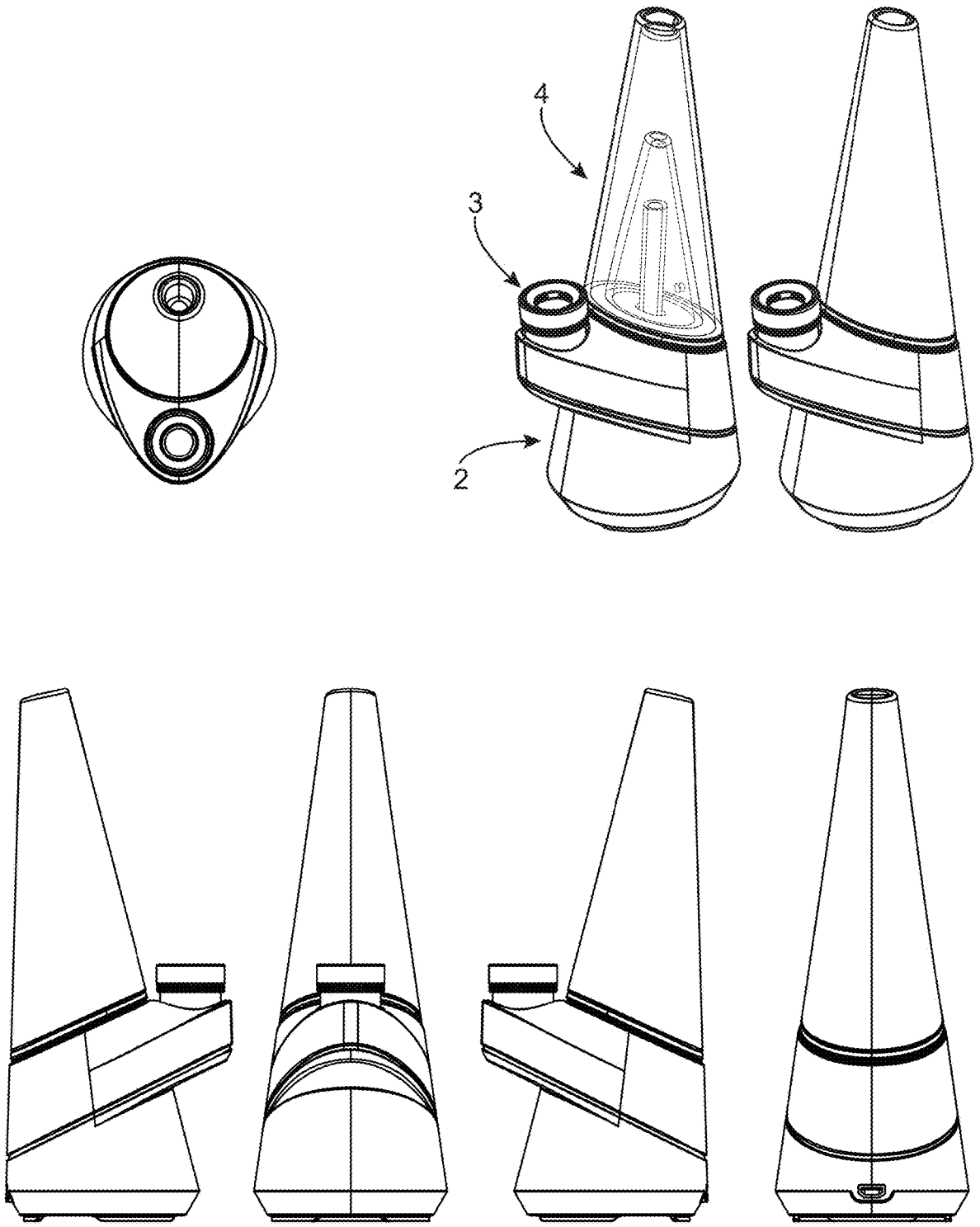
FIG. 11 shows embodiments of a portable electronic vaporizing device comprising a base, atomizer and mouthpiece.

Referring to FIG. 11, an embodiment of a portable electronic vaporizing device 1 is shown according to aspects of the disclosure herein. The portable electronic device 1 comprises a base 2, and atomizer 3 and the mouthpiece 4

(which may correspond to any of the embodiments of the mouthpiece as shown in FIGS. 1-10B disclosed herein, e.g., including a sealable attachment piece). The atomizer 3 is configured to receive a vaporizable product therein and to heat the vaporizable product to form a vapor therefrom. As discussed above, the mouthpiece 4 comprises an outlet where a user can inhale the vapor produced by the atomizer, optionally with water or other substances entrained therein. The base 2 provides a gas flow connection between the atomizer 3 and mouthpiece 4, to deliver the vaporized product from the atomizer 3 to the mouthpiece 4 for delivery to the use via inhalation thereof. The base 2 can also comprise a housing for one or more components for powering and/or controlling the device 1. For example, the base may contain compartments therein for storing a power source, such as a battery, for powering elements of the device 1 such as a heating element used in the atomizer 3. In a case where the device is powered by a rechargeable battery, such as a lithium ion battery, the base 2 may also comprise a charging port connectable to a battery charger (not shown). The base may also have compartment doors to allow access to a battery or other components held within the housing. The base 2 may also house further control circuitry for controlling the device, such as to provide predetermined heating cycles or heating programs, and may also allow for user interaction with the device via control buttons and/or control interface, a display and/or lights to signal to the user, and/or other control and operation features.

Figure 12:
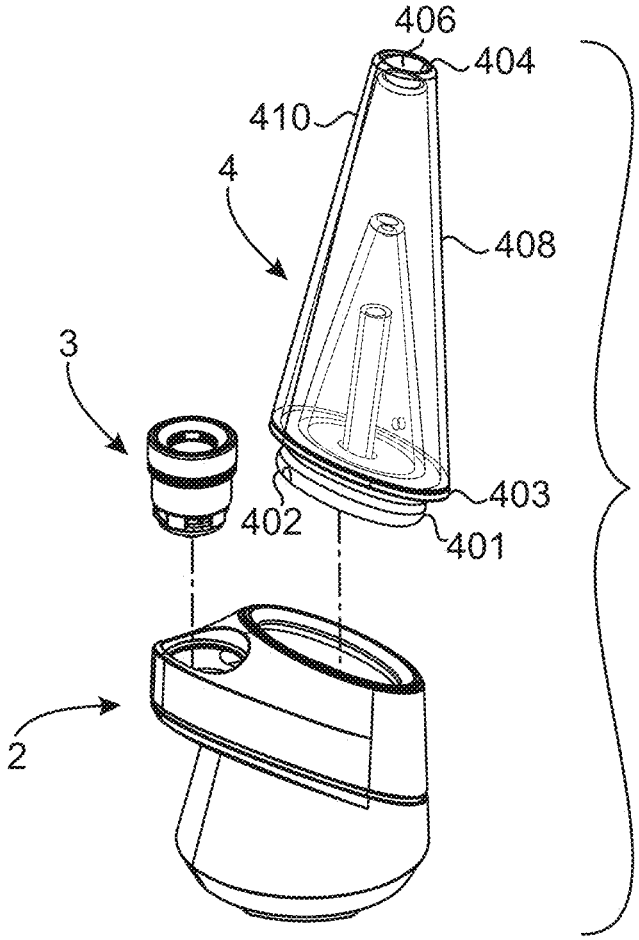
FIG. 12 is an exploded view of the device of FIG. 11.

Referring to FIG. 12, an embodiment of the device 1 is shown in exploded view, with the mouthpiece 4 and atomizer 3 removed from the base 2. In one embodiment, the mouthpiece 4 is removably attachable to the base 2, for example so as to allow a user to readily remove the mouthpiece for cleaning and/or replacement, as is described in further detail herein. In yet another embodiment, the atomizer may be removably attachable to the base, for example so as to allow a user to replace the atomizer 3 when no longer serviceable, for cleaning of the atomizer, and/or to more readily allow access to a container (e.g. bowl) where a vaporizable product may be loaded into the atomizer 3. In one embodiment, both the atomizer 3 and the mouthpiece 4 may be removably attachable to the base 2. In yet another version, the atomizer 3 may be independently removable from the base 2. That is, the atomizer 3 may be configured to be removably attached to the base such that it can be removed therefrom, without requiring that the mouthpiece 2 be removed beforehand. Referring to FIG. 12 it can be seen that the atomizer 3 itself is external to the mouthpiece 4, and its connection to the base 2 is also at a position that is outside the mouthpiece 4, such that the atomizer 3 can be removed from the base 2 while the mouthpiece is kept attached to the base. Similarly, according to the embodiment as shown, the mouthpiece 4 can be removed from the base 2 independently of the atomizer 3, as the mouthpiece 4 and its connection to the base are external to the atomizer, and so the mouthpiece 4 can be removed from the base 2 without requiring removal of the atomizer 3. Furthermore, in the embodiment as shown in FIG. 12, the atomizer 3 can be loaded with vaporizable product without requiring removal of the mouthpiece 4, and without requiring passing of the vaporizable product through a portion of the mouthpiece, as the atomizer can be accessed separately from the mouthpiece.

Figure 13:
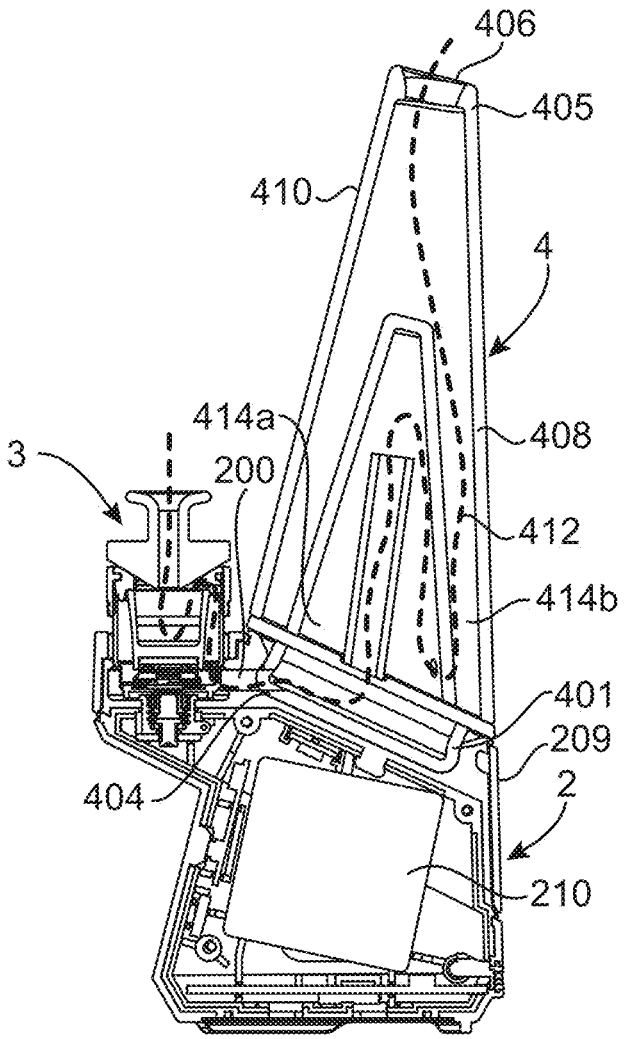
FIG. 13 is a schematic view of the device of FIG. 11.

Referring to FIG. 13, an embodiment of a gas flow path through the portable electronic device 1 is shown. In one embodiment, a flow of ambient air is received in the atomizer 3, where the ambient air is entrained with vaporizable product that is vaporized in the atomizer via a heating element. The gas comprising the ambient air and vaporizable product flows from the atomizer 3 to a portion of the base 2 having a gas flow conduit therein, and which provide a sealed gas flow connection between the atomizer 3 and mouthpiece 4. The gas received into the mouthpiece 4, where it is directed to an inhalation outlet of the mouthpiece, where the gas comprising the vaporizable product can be inhaled by the user. In one embodiment, water is provided in a region of the mouthpiece 4 such that water can cool and/or filter the gas passing through the mouthpiece, thereby providing a more pleasant inhalation experience to the user. An embodiment of an overall flow path of gas through the device 1 is depicted via dashed lines in FIG. 13. According to yet a further embodiment, the mouthpiece 4 can comprise any of the mouthpiece embodiments as shown in FIGS. 1-10B and including a sealable attachment piece.

Referring to FIGS. 14A-14D, embodiments of the base 2, and mechanism of attachment of the base 2 to one or more of the atomizer 3 and mouthpiece 4 are described in more detail. As shown in FIGS. 14A-14D, the base 2 comprises a gas flow path conduit 200 therein, the gas flow path conduit 200 comprising a conduit inlet 201*a* and a conduit outlet 201*b*, an embodiment of which may also be viewed with respect to FIG. 15. The conduit inlet 201*a* receives gas exhausted from the atomizer 3, and provides a flow of gas to the mouthpiece 4. In one embodiment, one or more airtight seals are formed between the base 2 and/or the atomizer 3 and mouthpiece 4, so as to create an airtight gas flow path between from the atomizer, through the gas flow path conduit 200 in the base 2, and to the mouthpiece 4. In the embodiment as shown, the gas flow conduit 200 in the base separates an atomizer internal gas flow path from a mouthpiece internal flow path.

According to one embodiment, the atomizer 3 and/or mouthpiece 4 are removably attachable to the base 2 via a fastening feature 202 that allows for repeated removal and re-insertion of the atomizer 3 and/or mouthpiece 4 into the base. In one embodiment, the fastening feature 202 may be located on the base 2, and/or the fastening feature 202 may be located on one or more of the atomizer 3 and mouthpiece, and/or the components may have mutually complementary fastening features that allow for repeatable removal and re-attachment of the atomizer 3 and/or mouthpiece 4 to the base 2.

In the embodiment as shown in FIGS. 14A-14D, the base 2 comprises first and second recessed regions 203*a* and 203*b*, comprising cavities formed in the base 2 that are configured to receive at least a portion of the atomizer 3 and mouthpiece therein. For example, the base can comprise a first recessed region 203*a* configured to receive at least a portion of the atomizer 3 therein, and a second recessed region 203*b* configured to receive at least a portion of the mouthpiece 4 therein. In one embodiment, the fastening feature 202 is provided as part of the base, and can comprise one or more airtight sealing members 204*a*, 204*b* located in the base, such as a first airtight sealing member 204*a* provided in the first recessed region to retain the atomizer therein, and/or a second airtight sealing member 204*b* provided in the second recessed region to retain the mouthpiece 4 therein. In yet another embodiment, the fastening feature 202 may be provided on the atomizer and/or mouthpiece. For example, the mouthpiece 4 (including any of the embodiments of the mouthpiece as shown in FIGS. 1-10B) may comprise a snap region 401 that is configured to be received by the second recessed region of the base, and that comprises a fastening feature 202 thereon to retain the step region in the base, as is described in more detail hereinbelow. In one embodiment, the fastening feature that removably retains one or more of the atomizer and/or mouthpiece in their respective recessed region is also capable of providing an airtight seal between the base and atomizer and/or mouthpiece. In another embodiment, the fastening feature comprises a structural element that is separate from and/or provided in addition to an airtight sealing member. For example, in one embodiment, the base and atomizer and/or mouthpiece may be fastened together by a fastening feature that does not provide an airtight seal, but an airtight sealing member may be provided about the gas flow interfaces of the base, such as about one or more of the base conduit inlet 201*a* and conduit outlet 201*b*, to provide an airtight connection for gas flowing from the atomizer through the base conduit and into the mouthpiece 4. According to yet another embodiment, the device comprises both fastening elements that provide an airtight seal, as well as further airtight sealing members along the gas flow path to ensure an airtight airflow. For example, referring to FIG. 4B, an airtight sealing member 204*c* can be provided about the gas conduit outlet 201*b* to provide an airtight connection to the mouthpiece inlet.

Figure 15:
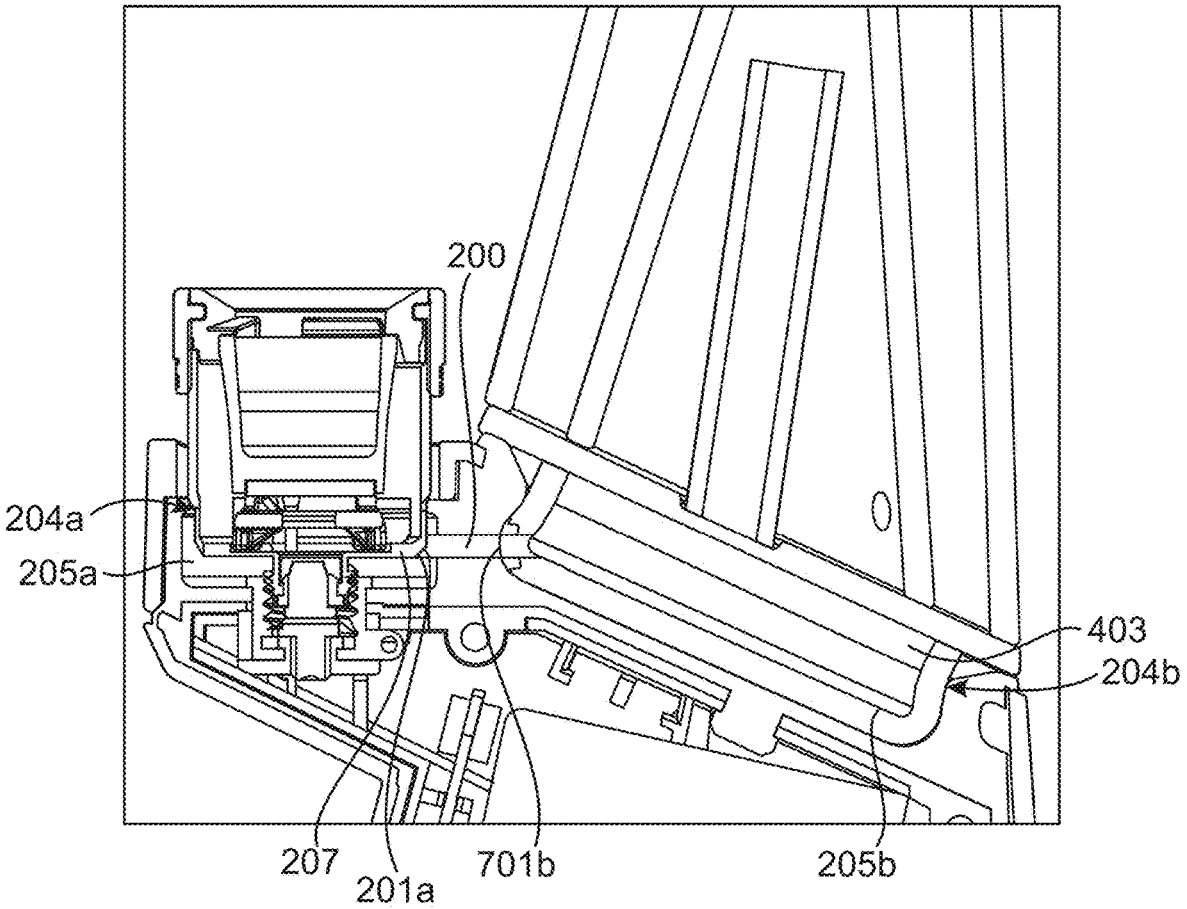
FIG. 15 shows a close-up schematic view of the device of FIG. 11.

In one embodiment, the base 2 is capable of forming a first airtight compartment 205*a* via airtight seal with the atomizer, and/or is capable of forming a second airtight compartment 205*b* via an airtight seal with the mouthpiece 4, as shown in FIG. 15. In one embodiment, the base comprises a first recessed receiving region 203*a* formed therein that is configured to receive the atomizer 3, the first recessed receiving region 203*a* comprising an annular sealing region 204*a* provided about an internal circumference 206*a* of the first recessed receiving region, to form the airtight compartment between the base and atomizer in the portion of the first recessed region below the annular sealing region. In another embodiment, the base comprises a second recessed receiving region 203*b* formed therein that is configured to receive the mouthpiece, the second recessed receiving region 203*b* comprising an annular sealing region 204*b* provided about an internal circumference 206*b* of the second recessed receiving region, to form the airtight compartment between the base and mouthpiece in the portion of the second recessed region below the annular sealing region. In another embodiment, the base comprises a first recessed receiving region 203*a* formed therein that is configured to receive the atomizer, and a second recessed region 203*b* formed therein that is configured to receive the mouthpiece, and wherein at least one of the atomizer and/or mouthpiece comprise an annular sealing region provided about an external circumference thereof, to form an airtight compartment between the base and atomizer and/or mouthpiece in the portion of the first and/or second recessed regions below the annular sealing region 204*a*, 204*b*. In another embodiment, the base comprises a second recessed region 203*b* formed therein that is configured to receive the mouthpiece, and wherein a sealing region is provided on one or more of the base and/or mouthpiece about one or more of the gas flow path conduit outlet on the base and/or the at least one mouthpiece inlet on the mouthpiece, to form an airtight seal between the gas flow conduit outlet and the mouthpiece inlet. Furthermore, in one embodiment at least a portion of the first airtight compartment in the first recessed region 203*a* forms a passage 207 for flow of gas from the atomizer to the gas flow path conduit in the base, below the annular sealing region, as shown in FIG. 15.

In one embodiment, an annular sealing region provided about a recessed cavity in the base, and/or about a circumference of the atomizer and/or mouthpiece, comprises a plastic, elastomeric, rubber and/or silicone material. In another embodiment, the base 2 comprises one or more plastic, elastomeric, rubber and/or silicone sleeves 208 conformally lining one or more recessed regions 203*a*,203*b*, and/or the conduit 200. In one embodiment, the sleeve 208 may be a single sleeve piece lining at least a portion of the recessed regions 203*a*, 203 and conduit. According to yet another embodiment, at least one of the atomizer and mouthpiece can comprise a plastic, elastomeric, rubber and/or silicone sleeve conformally lining at least a part of a surface thereof that is received by first and/or second recessed regions of the base. In yet another embodiment, the sleeve 208 provided in one or more of the recessed regions 203*a*, 203*b* comprises one or more annular protrusions extending therefrom, such as by molding of the sleeve material to form the protrusions, which can serve as airtight sealing members 204*a*, 204*b* between the base and atomizer and/or mouthpiece.

In one embodiment, the base 2 comprises a second recessed receiving region 203*b* formed therein that is configured to receive the snap region 401 of the mouthpiece 4, the second recessed receiving region comprising the annular sealing region 204*b* provided about an internal circumference thereof, to form an airtight compartment between the base and snap region of the mouthpiece in the portion of the second recessed region below the annular sealing region. In yet another embodiment, the second recessed receiving region further comprises the annular sealing region 204*c* about the conduit outlet 201*b* to form an airtight seal between the conduit outlet 204*c* and a mouthpiece inlet 402. In one embodiment, the gas flow path conduit outlet 201*b* in the base is located below the annular sealing region 204*b* in the second recessed region, such that an interface between the gas flow path conduit outlet in the base, and the mouthpiece inlet is located in an airtight compartment portion of the second recessed receiving region. In one embodiment, the annular sealing region 204*b*, 204*c* comprises at least one of a rubber, elastomeric, and a silicone material. In yet another embodiment, the second recessed region is sized an shaped to accommodate a snap region 401 of the mouthpiece that comprises an annular indentation 403 formed about a circumference of the mouthpiece towards a bottom end 404 of the mouthpiece that is distal to an inhalation outlet 406 of the mouthpiece, the annular indentation being configured to conformally mate with the annular sealing member in the second recessed region to so as to form the airtight compartment.

As described above, in one embodiment the base 2 comprises a housing 209 that is configured to house a power source 210 for powering a heating element in the atomizer 2, and optionally comprises one or more control elements for operating components of the device 1. For example, in one embodiment the power source 210 can comprise a rechargeable battery, such as a lithium-ion battery. The housing may also contain outlets to connect the device with an electrical outlet and/or other devices, and may house control elements such a CPUs and/or wireless transmitters for controlling heating and vapor production with the device, either via direct or wireless input into the device by a user.

Figure 16A:
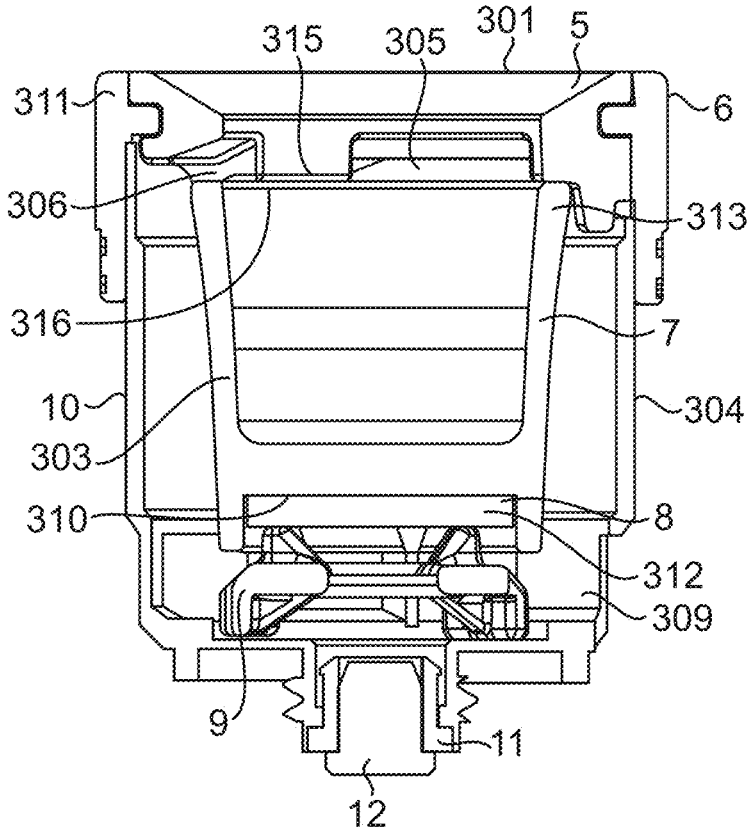
FIGS. 16A-16C show embodiments of an atomizer.
Figure 16B:
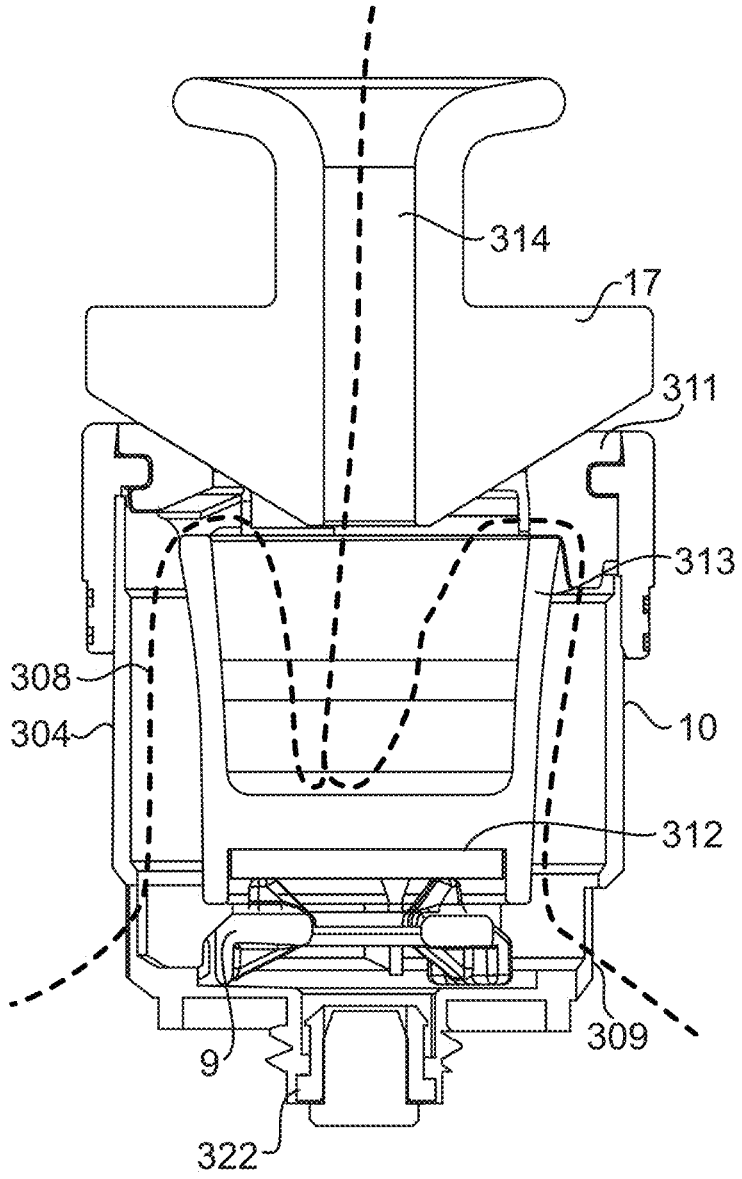
Figure 16C:
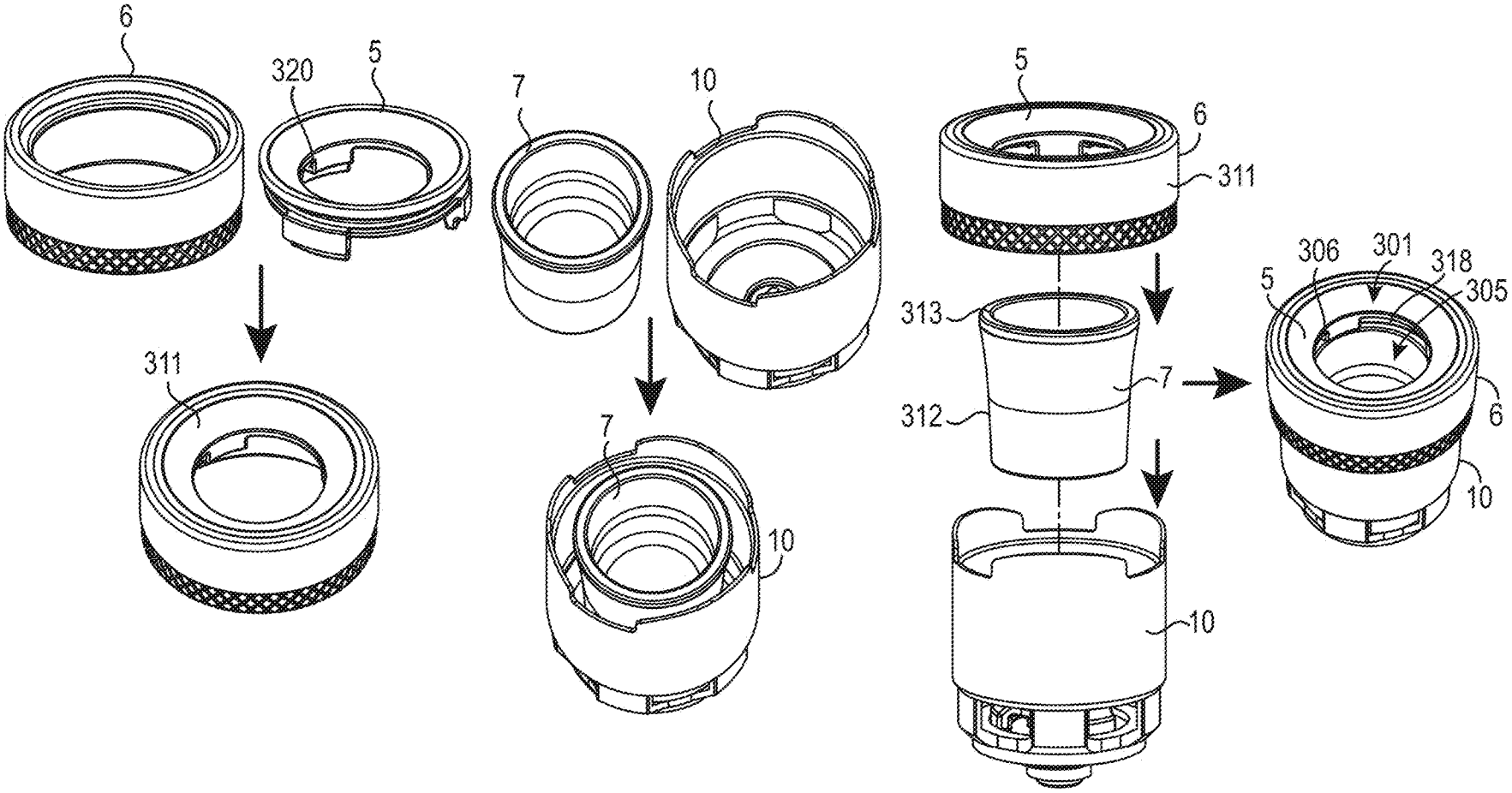

Referring to FIGS. 16A-16C, an embodiment of an atomizer 3 is described. In the embodiment as shown, the atomizer 3 is removably attachable to the base, an includes an atomizer inlet 301 configured to receive a flow of gas into the atomizer 3, and an atomizer housing 10 comprising one or more atomizer housing walls 304 that at least partially define an atomizer internal flow path therein. The atomizer 2 is further configured to contain a container 7 (e.g., a bowl)

within the atomizer housing 302 that is capable of holding a vaporizable product therein. The atomizer further comprises a heating element 8 capable of heating the vaporizable product held in the container 7. According to the embodiment as showing, the atomizer comprises a first container inlet 305 capable of introducing gas into the container 7 to entrain vaporizable product therein, and comprises one or more second container outlets 306 capable of flowing the gas having the vaporizable product entrained therein into an atomizer internal flow path 308. Embodiments of the atomizer 3 comprise one or more atomizer outlets 309 capable of receiving the flow of gas from the atomizer internal flow path 308, and providing the flow of gas to the conduit inlet 201*a* of the base 2.

According to one embodiment, the at least one heating element 8 is disposed within the atomizer housing 10. For example, the at least one heating element 8 may be disposed below a bottom surface 310 of the container 7 that is adapted to receive the vaporizable product therein. In one embodiment, the heating element comprises a ceramic heating plate, such as an alumina plate. The heating element 8 may be capable of resistively heating the container 7 via thermal contact therewith, as in direct contact with the bottom surface 310. In one embodiment, the heating element 8 is attached to conductive elements such as wires leading to the power source (e.g. battery) to provide an applied voltage for the resistive heating. In one embodiment, the container 7 adapted to receive and hold the vaporizable product comprises a thermally conductive ceramic material, such as alumina, such that placing the container is in thermal contact with the heating element causes heating of the container.

According to yet another embodiment, the atomizer 3 comprises a bottom insulating element 9 comprising a spacer disposed between the heating element 8 and atomizer housing 10 that thermally insulates the heating element 8 from the atomizer housing 8. The bottom insulating element 9 may also act to secure the heating element in position at a bottom end 312 of the container, such as in contact with the bottom surface of the container 7. In one embodiment, the bottom insulating element comprises a ceramic having a lower thermal conductivity than the container and/or heating element, so as to thermally isolate the container and/or heating element from the atomizer housing. For example, in one embodiment the bottom insulating element can comprise a thermal conductivity of less than 4 W/mk, less than 3.5 W/mk and/or less than 3 W/mk, whereas the container and/or heating element may comprise a thermal conductivity of at least 10 W/mk, at least 15 w/mk and/or at least 20 W/mk.

According to another embodiment, the atomizer 3 comprise a top insulating element 311 that thermally insulates a top end 313 of the container 7 from the atomizer housing 10. In one embodiment, the top insulating element 311 is configured to receive a carb cap 17 thereon. For example in one embodiment, the device 1 is configured to operate with a carb cap 17 positioned upstream of the atomizer 3, the carb cap comprising a stopper having a conduit 314 formed therein to provide a flow of ambient air into the atomizer 3. In one embodiment, the container 7 is thermally insulated from the atomizer housing 10 by both the bottom insulating element 9 that positions the container within the housing at a bottom end of the container, and the top insulating element 311 that positions a top end of the container in the housing. In one embodiment, referring to FIG. 6C, the top insulating element 311 comprises inner and outer annular insulating rings 5, 6. In one embodiment, an inner circumference of the inner annular insulating 5 ring defines the atomizer inlet 301, and is in communication with the first inlet 305 of the container 7. In the embodiment as shown in FIG. 16A, the atomizer inlet 301 is directly above the first inlet 305, and/or the atomizer inlet 301 and first container inlet may comprise the same inlet. That is, in one embodiment, the atomizer inlet may be aligned with and lead to a container inlet positioned below the inner annular ring 5 of the top insulating element 311.

In one embodiment, the atomizer 3 comprises an outer annular ring 6 that forms an annular jacket that is flush with the outer surface of the inner annular ring 5, and extends in an axial direction beyond the inner annular ring such that a portion of the interior surface of the outer annular ring is in contact with an outer surface of the atomizer housing 10. In one embodiment, the outer annular ring 6 may secure the inner annular ring 5 to the atomizer housing 10 via frictional forces and/or via a snap mechanism or other fastening mechanism between a portion of the interior surface of the outer annular ring and the outer surface of the atomizer housing. In one embodiment, the outer annular ring comprises an annular jacket that forms an airtight seal with the atomizer housing.

In one embodiment, one or more of the inner and outer annular rings 5, 6 are capable of thermally isolating the container 7 from the atomizer housing 10, by having a lower thermal conductivity. For example, one or more of the inner and outer annular insulating rings can comprise a thermal conductivity of less than 4 W/mk, less than 3.5 W/mk and/or less than 3 W/mk, whereas the container may comprise a thermal conductivity of at least 10 W/mk, at least 15 w/mk and/or at least 20 W/mk. IN one embodiment, a bottom surface 315 of the inner annular insulating ring 5 is in contact with an upper surface 316 of the container 7.

In one embodiment, one or more of the container 7 and/or thermally insulating element 311, such as the inner annular ring 5, comprise one or more apertures 318 therein that correspond to the one or more container second outlets 306. For example, in one embodiment the inner annular ring 5 comprises one or more indentations 320 formed in the bottom surface 315 thereof, such as about a circumference thereof, which form one or more apertures 318 between the bottom surface 315 of the inner annular ring 5 and the top surface 316 of the container 7. In yet another embodiment, the inner annular ring 5 comprises one or more apertures formed in the body thereof, such as about a circumference thereof, to provide the one or more container outlets. In yet another embodiment, the container itself comprises one or more apertures 318 formed in one or more walls thereof, wherein the one or more apertures comprise the one or more second container outlets 306. According to certain embodiments, first container inlet 305 introduces a gas flow received through the inner insulating annular ring 5 into the container 7, and the one or more second container outlets 306 flow gas out of the container through the one or more apertures 318. The second container outlets 306 may thus be a separate aperture and/or opening than the first container inlet 305, such that air comes through the inlet and passes through a separate outlet when exiting the container 7.

Furthermore, in one embodiment, the top insulating element 311 is removable from the atomizer housing 10 to allow access to the container 7. For example, the insulating element 311 may be removable by simply lifting or twisting the top insulating element form the atomizer housing 10. According to yet another embodiment, the atomizer housing 10 comprises a lower portion 322 that is threaded, and that may be complementary to a threaded socket in the first recessed region 203*a* of the base 2, so the atomizer can be screwed into the threaded socket of the base. In yet another embodiment a lower portion of the atomizer housing may connects to the base via a magnet, span mechanism or other fastening feature.

According to one embodiment, atomizer housing at least partially directs gas from the one or more second container gas outlets 306 along the internal atomizer gas flow path 308 (shown as a dashed line in FIG. 16B), in a passage 324 formed between walls of the container 7 and the atomizer housing 10. The atomizer housing 10 can comprises one or more apertures/outlets 309 formed therein to flow gas from the internal atomizer gas flow path 308 to the airtight passage 207 that is external to the atomizer housing in the first recessed region 203*a* of the base 2. In one embodiment, the atomizer housing apertures/outlets 309 are located at a lower end of the atomizer housing, and the atomizer housing 10 redirects flow of the gas from the one or more second container gas outlets 306 in a downward direction along a passage 324 formed between the housing walls and container walls, to the atomizer housing apertures/outlets 309. As shown in FIG. 16B, in one embodiment a flow of gas through the atomizer 8 comprises a flow through the first container inlet into a top of the container, flow out of the container through second container outlets that are separate from the inlet, and that are towards a top 313 of the container, flow downward between the atomizer housing and container wall towards a bottom of the atomizer and through apertures of the atomizer towards the bottom of the atomizer housing.

In one embodiment, the one or more second container outlets 306 are located radially externally to the first container inlet 305, and/or are positioned in an arrangement circumferentially surrounding the first container inlet 305. The second container outlets 306 may also be located towards a top end of the atomizer and/or container. In a further embodiment, the apertures and/or outlets 309 for exhausting gas from the atomizer are located below the first container inlet and/or second container outlet, towards a lower end of the atomizer.

Further embodiments of the atomizer are described herein. For example, in one embodiment, inside the atomizer housing 10, a container comprising a bowl 7 is positioned on top of the heating element 8, and may be made of a highly thermally conductive material, which can include ceramic, quartz, or metals, allowing efficient heat transfer. The heating element 8 and the bowl 7 are secured and insulated by the bottom insulating element 9 and top insulating element 311 respectively, these two elements firmly locating the heating element 8 and bowl 7 within the atomizer. These two elements are made with low thermally conductive, yet high heat withstanding, material so that minimal heat is lost from the heating element and bowl. The top insulating element comprises an outer annular ring comprising sleeve 6, made of an insulating material, like silicone or plastic. The sleeve 6 fastens to the housing 10 and makes an airtight seal while the inner annular ring 5 insulates and positions the bowl 7. The sleeve 6 may also protect the user from heat and serves as a grip for screwing and unscrewing the atomizer.

After extended use the bowl 7 may become dirty. Because the top insulating element comprising in inner annular ring 5 and sleeve (6) are removable, the bowl can be taken out and easily cleaned. When the sleeve and top insulating element are assembled on the atomizer housing the bowl is held in place and a sealed airpath is formed. Air may enter the top of the bowl through a carb cap 17. The carb cap 17 may be capable of directing high velocity air to the bottom of the bowl, where the material is vaporized. Air then exits the top of the bowl as vapor through the second outlets which are apertures in the inner annular ring (5) above the bowl. These slots/apertures could also be cut into the top of the bowl. The vapor travels through the slots in the inner annular ring and down a gap formed between the bowl and the atomizer housing. The vapor can leaves the bottom of the atomizer and travels through an airpath into the mouthpiece. FIG. 16B shows a cross sectional view of the assembled atomizer with the carb cap and illustrates the airflow through the atomizer, entering through the carb cap and exiting out of the bottom of the atomizer.

In certain embodiments, material that leaks out of the bowl 7 can seep down into the bottom of the atomizer near the connection point. Accordingly, it may be important for this area to be sealed so that the leaking material does not inhibit the passing of the current from power source to heating element. This seal is provided by the electrode insulator 11 which holds the electrode 12. The electrode insulator secures and holds separately the electrode from the housing. One lead wire of heating element 8 can be held between the insulator and the housing 10, the other lead wire can be held between the insulator and the electrode, therefore a current path in and out of the heating element can be created. There can be also grooves cut into the atomizer housing to position these lead wires. The electrode insulator can press the wires into these grooves and make a water and airtight seal against the housing and electrode which may prevents leaking. In certain embodiments, material may also leak out of the bottom of the atomizer through the air cuts in the housing 10. Accordingly, it may be important that this material does not reach the connection point on the atomizer or the power source. When the atomizer is connected to the base, a rib 14 running around the bottom of the atomizer housing 10 can create a seal. This seal can create a separation between the air holes and connection point and may prevent any material from reaching the electrical connection points on the atomizer or base.

Furthermore, because the bowl 7, heating element 8 and inner annular ring 5 may interact with sticky material during use, there is a chance for them to become stuck together. In certain embodiments, if the bowl is twisted during use, for example while the user is tightening or untightening the atomizer by gripping the sleeve, the heating element could be twisted and could lead to subsequent breaking of its lead wires. Accordingly, features may be included in the atomizer housing 10 and inner annular ring 5. For example, slots in the atomizer housing 10 may line up with embossed features 16 in the inner annular ring 5, so that the two lock together and cannot be twisted independently. This protects the heating element from damage when tightening or loosening the atomizer from the base.

In one embodiment, the bowl itself can include a rib 15 around its bottom face, which is the face that interacts with the heating element. This rib may have three functions, it can positions the bowl, cover the heating element, and/or minimize heat loss, and it can shroud the heating element from debris. The debris could be water or liquid material that leaks down into the heating elements environment. Since the heating element may operate at a high temperature, a substance of room temperature contacting the heating element can result in significant thermal shock which could damage or permanently break the heating element. The rib on the bottom of the bowl blocks debris by creating a protective wall around the heating element.

Referring to FIGS. 11-13, 15 and 17, aspects of embodiments of the mouthpiece 4 are further described, including aspects that may be incorporated into the embodiments as depicted in FIGS. 1-10B, where suitable. In one embodiment, the mouthpiece 4 is removably attachable to the base 2. The mouthpiece can generally comprise a mouthpiece housing 408, comprising one or more mouthpiece walls 410 at least partly defining a mouthpiece internal flow path 412 through the mouthpiece housing (e.g., as shown in FIG. 8B and/or FIG. 13). The mouthpiece can further comprises the inhalation outlet 406 formed in a region of the one or more mouthpiece walls 410, such as towards a top end 405 of the mouthpiece 4. The mouthpiece can further comprise at least one mouthpiece inlet 402 capable of being placed in communication with the conduit outlet 201*b* of the base 2 upon attachment of the mouthpiece 4 to the base 2, to receive a flow of gas into the mouthpiece 4 from the base 2. In some embodiments a gas flowed through the mouthpiece from the mouthpiece inlet 402 to the inhalation outlet 406, may take a convoluted path through the interior volume of the mouthpiece and along the internal flow path, such as for example when a water filtering region is provided as part of the mouthpiece.

In one embodiment, the mouthpiece comprises a snap region 401 that is configured to removably attach the mouthpiece to the base. For example, in one embodiment, the base can comprises the second recessed receiving region 203*b* for receiving the mouthpiece therein via the snap region 401, which may be shaped and sized to fit within the second recesses receiving region. The snap region 401 may be located at the bottom end 404 of the mouthpiece, and in certain embodiments the mouthpiece inlet 402 may located in the snap region 401, of the mouthpiece. In one embodiment, the second receiving region 403*b* may be at least partially lined with a rubber, silicone, and/or elastomeric sleeve to conformally mate the second recessed region with the snap region of the mouthpiece. In yet another embodiment, at least a portion of the snap region of the mouthpiece may be lined with a rubber, silicone, and/or elastomeric sleeve to conformally mate the second recessed region with the snap region of the mouthpiece. As yet another example, in one embodiment, the sleeve 208 comprises an annular sealing region 204*b* that protrudes inwardly from sidewalls of the second recessed region to contact and form an airtight seal with the mouthpiece.

In yet another embodiment, the mouthpiece comprises one or more a water filtering regions 414*a*, 414*b*, capable of holding a volume of water therein, the water filtering region being located along the mouthpiece internal flow path, such that the vapor passes through the water in the water filtering region. In the embodiment as shown in FIG. 13, a volume of water can be provided to partly fill in internal volume of the mouthpiece volume along a lower region of the internal mouthpiece volume. In the embodiment as shown in FIGS. 1-10B, the water filtering regions 414*a*, 414*b* may be disposed at the bottom portion of the main chamber 814 and the bottom portion of the second chamber 806 (e.g., the external chamber of the internal gas flow structure 800) with the second aperture 816 placing the water filtering regions 414*a*, 414*b* in communication with one another.

In one embodiment, the mouthpiece 4 comprises a snap region 401 with one or more fastening features 202 on an external surface 426 thereof to fasten the snap region to the recessed region 203*b* of the base 2. In one embodiment, the fastening feature 202 may provide a sealing fit between the snap region and the recessed region when the snap region is inserted into the recessed region. In one embodiment, the fastening features may be able to removably fasten the mouthpiece to the base such that mouthpiece can withstand at least 2 lbs, at least 3 lbs and/or at least 5 lbs of vertical force before the snap region of the mouthpiece releases from the recessed region of the base.

In yet another embodiment, the at least one mouthpiece inlet 402 may direct gas into the mouthpiece in a direction that is not co-linear with and/or that is other than a direction that gas exits the mouthpiece via the inhalation outlet 406. For example, the at least one mouthpiece inlet may direct gas into the mouthpiece in a direction that is substantially perpendicular to a direction that gas exits the mouthpiece via the inhalation outlet.

Figure 17:
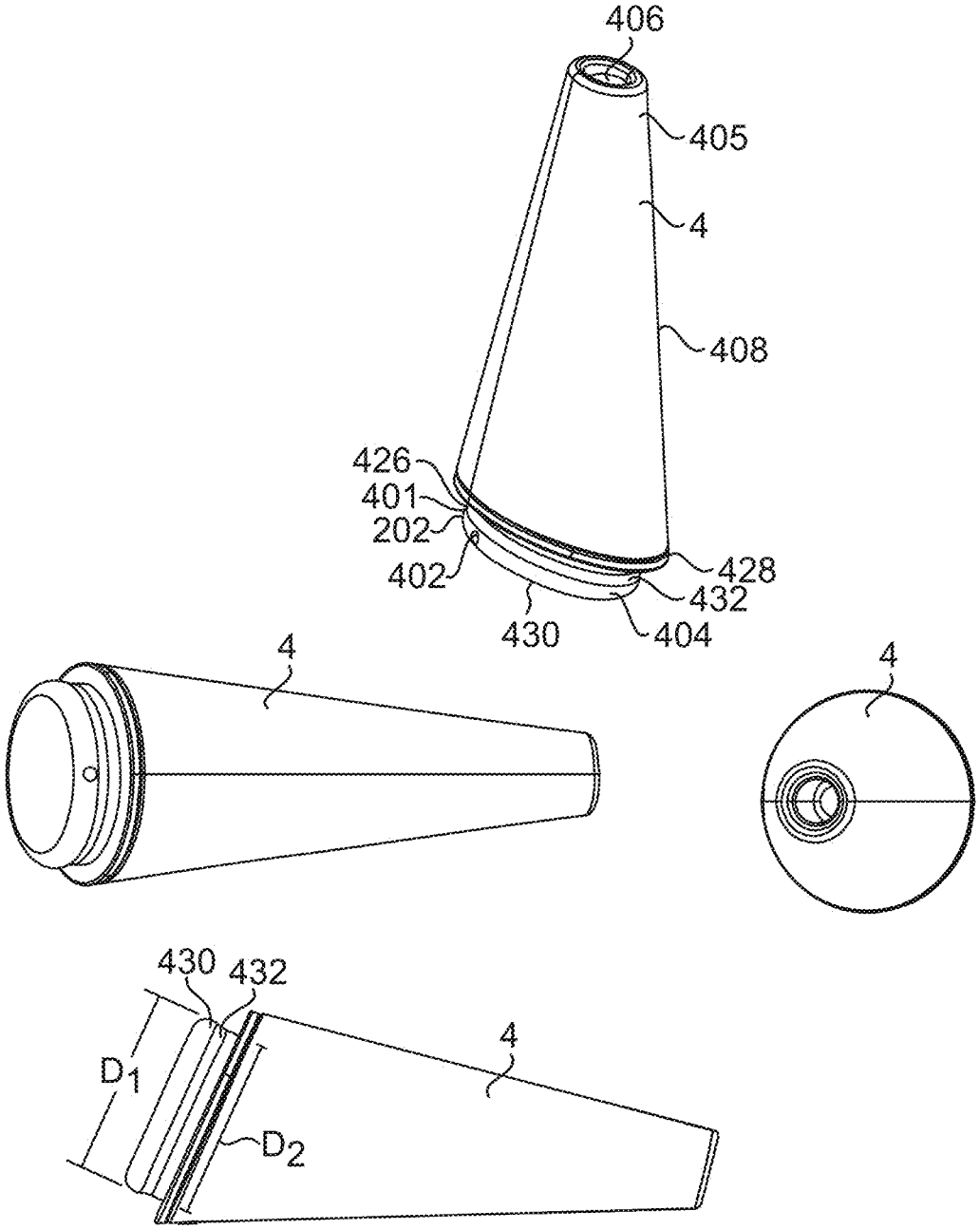
FIG. 17 shows views of embodiments of a mouthpiece.

In one embodiment, the at least a portion of the mouthpiece housing, and even the entire mouthpiece housing, may be formed of glass. In one embodiment, the snap region 401 of the mouthpiece may also be formed of glass. Internal structures such as internal walls between compartments, and tubes for introduction of gas, may also be formed of glass. In one embodiment, the snap region 401 of the mouthpiece comprise a greatest diameter $D_1$ (the largest diameter along the height of the snap region, see e.g. FIG. 12) that is at least 20 mm, at least 30 mm, and/or at least 50. In some embodiments, the snap region 401 may be considered to be that portion of the mouthpiece that is received by the recessed region of the base. As shown in FIG. 17, a body region 428 that is clear of the recessed region when the mouthpiece is connected to the base, may in some embodiments have a diameter that exceeds that of the snap region 401 that fits within the base. Furthermore, in one embodiment an internal volume of the mouthpiece 4 is configured to accept at least 1 fluid ounces of water therein during operation a device comprising the mouthpiece.

Figure 14A:
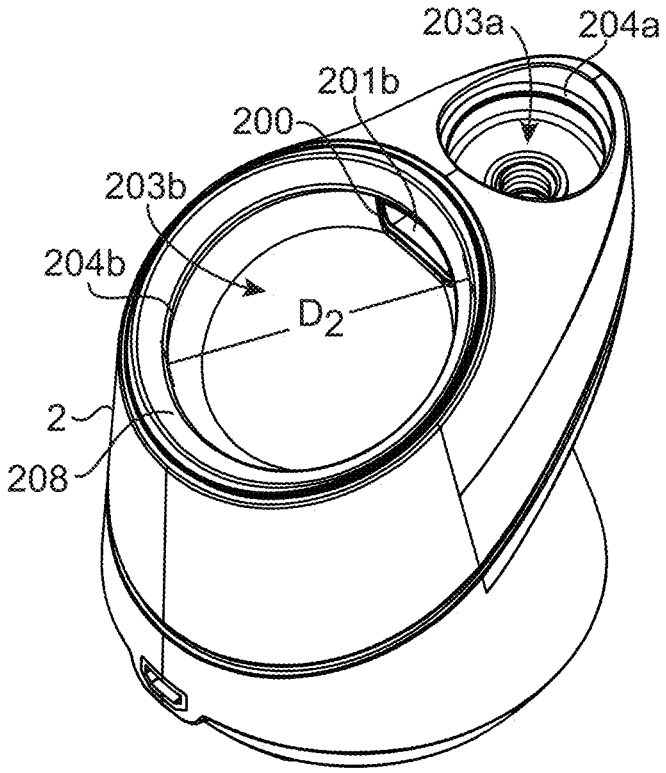
FIGS. 14A-14D shows an embodiment of a base.
Figure 14B:
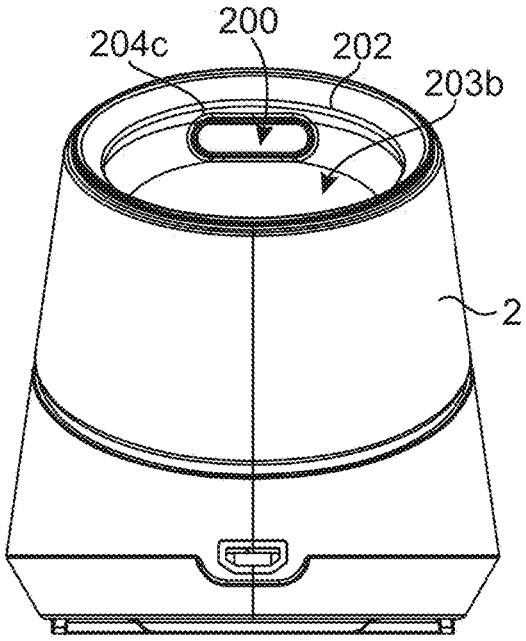
Figure 14C:
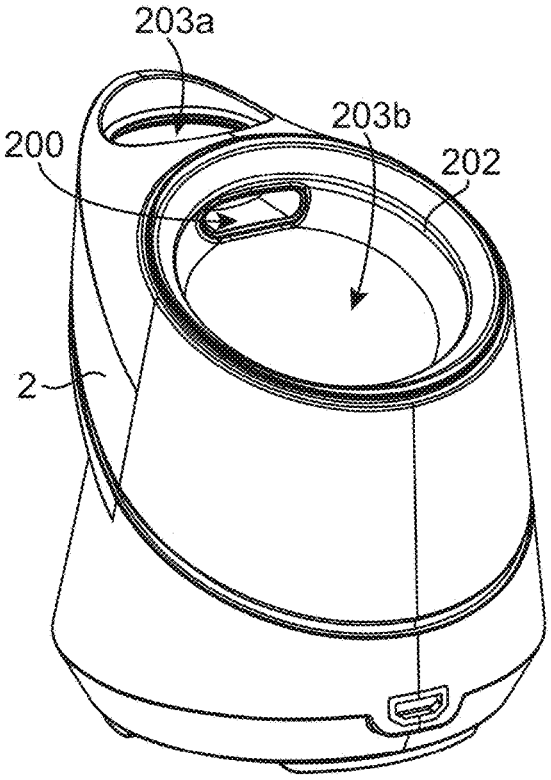
Figure 14D:
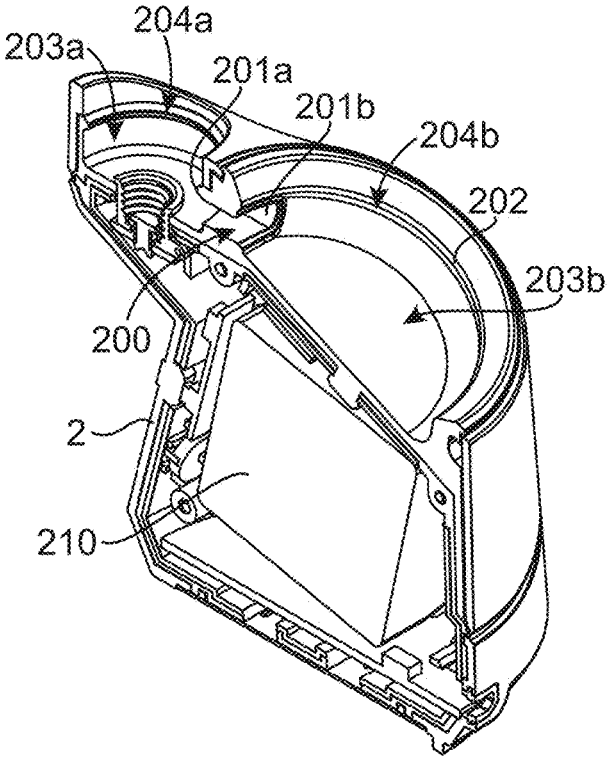

In one embodiment, referring to FIG. 17, the snap region 401 of the mouthpiece can comprises a fastening feature 202 comprising a circumferentially bulging protrusion 430 along a height of the snap region, where a diameter D of the protrusion 430 exceeds a minimum diameter $D_2$ of the recessed region of the base at some point along the height of the region (e.g., at a point where a sealing member 204*b* protrudes into the recessed region, see FIG. 14A). In certain embodiments, passing the bulging protrusion 430 past the minimum diameter $D_2$ of the recessed region causes the snap region to be removably retained in the recessed region. In one embodiment, the mouthpiece further comprises a fastening feature 202 comprising an annular indentation 432 formed about a circumference of the snap region portion of the mouthpiece. For example, the annular indentation may be configured to conformally mate with the circumferential sealing member 204*b* extending from a sidewall of the recessed region of the base, so as to form a seal therebetween. In one embodiment, the annular indentation can comprise an annular groove and/or annular channel formed in the mouthpiece housing at the snap region. In one embodiment, the annular indention may be located above the at least one mouthpiece gas inlet in the snap region, and/or the circumferentially bulging protrusion may have the at least one mouthpiece inlet formed therein. According to yet another embodiment, the fastening feature comprises a tapering snap region profile, the snap region having a first region adjacent the bottom of the mouthpiece housing (e.g., at the bulging protrusion) having a first diameter $D_1$, and a second region that is spaced apart from the first region (e.g. at the annular indentation) having a second diameter $D_3$, and wherein the diameter of the snap region decreases from the first region to the second region (e.g., D3 is less than D1).

In one embodiment, a method of using a portable electronic vaporizer as described according to any of the embodiments herein, can comprise loading vaporizable product into the container, optionally at least partially filling the mouthpiece with water in water filter regions thereof, activating the heating element to at least partially vaporize the product in the container, and inhaling gas exiting the mouthpiece inlet, the gas comprising ambient air having vaporize product and water vapor entrained therein.

What is claimed is:

1. A mouthpiece for the inhalation of a product in the form of a gas, the mouthpiece comprising:

an inhalation outlet;

a mouthpiece housing comprising one or more mouthpiece walls at least partly defining a mouthpiece internal flow path through the mouthpiece housing;

a first opening at a first end of the mouthpiece housing; and at least one mouthpiece inlet configured to receive a flow of the gas at a second end of the mouthpiece housing;

wherein the mouthpiece further comprises:

an internal gas flow structure extending into an interior region of the mouthpiece housing and having:

a first chamber at least partly defined by at least one first housing that is configured to receive the flow of gas from the at least one mouthpiece inlet, the first chamber having an open end at a portion of the gas flow structure that is distal to the at least one mouthpiece inlet, and the at least one first housing comprising at least one first aperture therein that allows the flow of gas therethrough;

a second chamber at least partly defined by at least one second housing that is configured to receive the flow of gas via the at least one first aperture from the first chamber and direct the flow of gas towards at least one second aperture formed in the at least one second housing; and a main chamber at least partly defined by the mouthpiece housing that is configured to receive the flow of gas from the at least one second aperture from the second chamber and direct the gas towards the first opening at the first end of the mouthpiece housing, wherein the second chamber and main chamber are adapted to be at least partly filled with water for cooling and/or filtering of the gas as it passes through the second and main chambers, and wherein the at least one second aperture is configured to allow a flow of water between the second chamber and the main chamber, and wherein the mouthpiece further comprises:

a sealable attachment piece configured to at least partly seal a portion of the internal flow path within the mouthpiece housing, the sealable attachment piece comprising:

an upper sealing portion configured to be inserted into the first opening of the mouthpiece housing, the upper sealing portion configured to be transitioned between an open state in which gas is allowed to flow through the inhalation outlet, and a closed state in which gas is blocked from flowing through the inhalation outlet; and a lower sealing portion configured to be inserted into the open end of the internal gas flow structure, the lower sealing portion configured to be transitioned between an open state in which gas is allowed to flow through the at least one first aperture connecting the first and second chambers, and a closed state in which gas is blocked from flowing through the at least one first aperture between the first and second chambers, and an activating member configured to simultaneously transition the upper and lower sealing portions between the open and closed states upon activation thereof, wherein, in a case where the upper sealing portion and lower sealing portion are in their respective closed states, the portion of the mouthpiece internal flow path between the at least one first aperture and the inhalation outlet is sealed to trap any gas and/or water therebetween, and wherein, in a case where the upper sealing portion and lower sealing portion are in their respective open states, the portion of the mouthpiece internal flow path between the at least one first aperature and the inhalation outlet is open to allow a flow of gas and/or water therethrough.

2. The mouthpiece according to claim 1, wherein the lower sealing portion seals the open end of the first chamber in the internal gas flow structure, so as to form a portion of the internal flow path extending from the gas flow inlet to the second chamber.

3. The mouthpiece according to claim 1, wherein the first and second chambers of the internal gas flow structure respectively comprise an inner cylindrical chamber at least partly defined by a first cylindrical housing, and an outer cylindrical chamber at least partly defined by both the first cylindrical housing and a second cylindrical housing that is radially external to the first cylindrical housing, and wherein the at least one first aperture is formed in the first cylindrical housing so as to place the inner and outer cylindrical chambers in communication with one another.

4. The mouthpiece according to claim 3, wherein the flow of gas is received by the inner cylindrical chamber at a bottom portion of the inner cylindrical chamber from the at least one mouthpiece inlet, and wherein the first cylindrical housing is configured to direct the flow of gas towards an upper portion of the inner cylindrical chamber where the at least one first aperture is disposed in the first cylindrical housing.

5. The mouthpiece according to claim 3, wherein the flow of gas is received by the outer cylindrical chamber at an upper portion thereof, and wherein the first and second cylindrical housings direct the flow of gas downwardly through the outer cylindrical chamber and towards the at least one second aperture located towards a bottom portion of the outer cylindrical chamber.

6. The mouthpiece according to claim 3, wherein the first cylindrical housing comprises an open end of the inner cylindrical chamber at an end of the first cylindrical housing distal to the at least one mouthpiece inlet, and wherein insertion of the lower sealing portion of the sealable attachment piece into the open end seals the open end of the first cylindrical housing to direct gas received from the at least one mouthpiece inlet and passing through the inner cylindrical chamber into the outer cylindrical chamber via the at least one first aperture formed in the first cylindrical housing.

7. The mouthpiece according to claim 1, wherein the main chamber is external to and at least partly surrounds the internal gas flow structure.

8. The mouthpiece according to claim 7, wherein the main chamber is radially external to and at least partly surrounds the inner and outer cylindrical chambers, and the mouthpiece housing that at least partly defines the main chamber is configured to direct the gas received via the at least second aperture towards the inhalation outlet, the inhalation outlet being located at a position above the inner cylindrical chamber.

9. The mouthpiece according to claim 1, wherein the upper sealing portion of the sealable attachment piece comprises a plug portion and an upper cap portion that is in communication with a shaft extending from the upper cap portion to the lower sealing portion.

10. The mouthpiece according to claim 9, wherein the plug portion comprises one or more annular sealing rings to form a seal with an inner surface of the mouthpiece housing in a region proximate to the first opening at the first end of the mouthpiece housing.

11. The mouthpiece according to claim 9, wherein the upper cap portion is rotatable independently of the plug portion to act as the activating member that activates the transition between the open and closed states of the upper and lower sealing portions.

12. The mouthpiece according to claim 9, wherein the upper cap portion is translatable independently of the plug portion to act as the activating member that activates the transition between the open and closed states of the upper and lower sealing portions, and thereby act as the activating member.

13. The mouthpiece according to claim 9, wherein the upper sealing portion comprises one or more gas channels formed in the plug portion and/or upper cap portion to flow gas from the main chamber of the mouthpiece to the inhalation outlet.

14. The mouthpiece according to claim 9, wherein the upper cap portion comprises an opening corresponding to the inhalation outlet at an upper end thereof.

15. The mouthpiece according to claim 13, wherein the one or more gas channels passing through the upper sealing portion comprise one or more ports formed in a shaft extending from the upper cap portion, the shaft comprising a hollow portion therein forming an inner gas channel between the one or more ports and the inhalation outlet.

16. The mouthpiece according to claim 15, wherein at least a portion of the plug portion circumferentially surrounds the shaft at a portion thereof where the one or more ports are formed, and wherein an inner surface of the plug portion comprises circumferentially disposed sealing and non-sealing regions configured to engage with the one or more ports, such that when the sealing regions are engaged with the one or more ports, one or more of the gas channels are open to pass through the upper sealing portion to the inhalation outlet, and when the non-sealing regions are engaged with the one or more ports, the one or more gas flow channels are closed to prohibit a flow of gas through the upper sealing portion to the inhalation outlet.

17. The mouthpiece according to claim 15, wherein at least a portion of the plug portion circumferentially surrounds the shaft at a portion thereof where the one or more ports are formed, and wherein an inner surface of the plug portion comprises sealing and non-sealing regions configured to engage with the one or more ports, the sealing and non-sealing regions being longitudinally disposed along the inner surface of the plug portion, such that when the sealing regions are engaged with the one or more ports, the one or more of the gas channels are open to pass through the upper sealing portion to the inhalation outlet, and when the non-sealing regions are engaged with the one or more ports, the one or more gas channels are closed to prohibit a flow of gas through the upper sealing portion to the inhalation outlet.

18. The mouthpiece according to claim 16, wherein the circumferentially disposed sealing and non-sealing regions of the plug portion are engaged via rotation of the upper cap portion to rotate the one or more ports about the axis of the shaft to engage with the one or more sealing and non-sealing regions.

19. The mouthpiece according to claim 17, wherein the longitudinally disposed sealing and non-sealing regions of the plug portion are engaged via translation of the upper cap portion translate the one or more ports on the shaft longitudinally with respect to the plug portion, to engage with the one or more sealing and non-sealing regions on the inner surface of the plug portion.

20. The mouthpiece according to claim 18, wherein the sealing regions comprise finned windows comprising flexible sealing material, the finned windows comprising sealing fins that are extend from the inner surface of the plug portion and are capable of forming a seal about the one or more ports formed in the shaft such that gas entering the one or more gas channels at a lower end of the upper sealing portion is blocked from entering the one or more ports formed in the shaft and prevented from being passed to the inhalation outlet.

21. The mouthpiece according to claim 16, wherein the non-sealing regions of the inner surface of the plug portion comprise one or more inlet channels configured to pass the flow of gas from the mouthpiece main chamber and to the one or more ports in the shaft to flow the gas to the inhalation outlet, in a case where the non-sealing regions of the plug are engaged.

22. The mouthpiece according to claim 8, wherein the lower sealing portion of the sealable attachment piece comprises one or more lower annular sealing rings disposed on a lower portion of a rotatable shaft, the one or more sealing rings being configured to form a seal with a surface of the first housing of the first chamber in a region of the open end of the first chamber, to form at least a portion of the internal flow path directing the gas received through the at least one mouthpiece inlet to the at least one first aperture connecting the first and second chambers.

23. The mouthpiece according to claim 8, wherein the lower sealing portion comprises a lower region of a shaft comprising one or more lower sealing regions and lower non-sealing regions circumferentially disposed about an outer surface of the lower region of the shaft, wherein the one or more sealing regions and/or non-sealing regions are engaged with the at least one first aperture via rotation of the shaft, such that when the sealing regions are engaged with the at least one first aperture, the at least one first aperture is closed to prohibit a flow of gas and/or liquid therethrough, and when the non-sealing regions are engaged with at least one first aperture, the at least one first aperture if open to permit a flow of gas therethrough from the first chamber to the second chamber.

24. The mouthpiece according to claim 8, wherein the lower sealing portion comprises a lower region of a shaft comprising one or more lower sealing regions and lower non-sealing regions disposed longitudinally along an outer surface of the lower region of the shaft, wherein the one or more sealing regions and/or non-sealing regions are engaged with the at least one first aperture via translation of the shaft, such that when the sealing regions are engaged with the at least one first aperture, the at least one first aperture is closed to prohibit a flow of gas and/or liquid therethrough, and when the non-sealing regions are engaged with at least one first aperture, the at least one first aperture if open to permit a flow of gas therethrough from the first chamber to the second chamber.

25. The mouthpiece according to claim 9 wherein the upper and lower sealing portions are simultaneous engaged via rotation of the upper cap portion.

26. The mouthpiece according to claim 9, wherein the upper and lower sealing portions are simultaneous engaged via translation of the upper cap portion.

27. The mouthpiece according to claim 23, wherein the one or more sealing regions of the lower sealing portion comprise finned windows comprising flexible sealing material, the finned windows comprising sealing fins that are extend from the outer surface of the shaft and are capable of forming a seal about the at least one first aperture formed in the first housing such that gas and/or liquid is prevented from flowing through the at least one aperture between the first and second chambers.

28. The mouthpiece according to claim 1, wherein the mouthpiece is configured to receive a gas generated by one or more of vaporization and/or burning of a product.

* * * * *